US011353164B2

(12) United States Patent
Hoelen et al.

(10) Patent No.: US 11,353,164 B2
(45) Date of Patent: Jun. 7, 2022

(54) FILAMENT LAMP WITH REFLECTOR

(71) Applicant: SIGNIFY HOLDING B.V., Eindhoven (NL)

(72) Inventors: Christoph Gerard August Hoelen, Valkenswaard (NL); Ties Van Bommel, Horst (NL); Rifat Ata Mustafa Hikmet, Eindhoven (NL); Johannes Petrus Maria Ansems, Hulsel (NL); Robert Jacob Pet, Waalre (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/431,620

(22) PCT Filed: Feb. 18, 2020

(86) PCT No.: PCT/EP2020/054142
§ 371 (c)(1),
(2) Date: Aug. 17, 2021

(87) PCT Pub. No.: WO2020/173743
PCT Pub. Date: Sep. 3, 2020

(65) Prior Publication Data

US 2022/0074553 A1 Mar. 10, 2022

(30) Foreign Application Priority Data

Feb. 28, 2019 (EP) ..... 19159892

(51) Int. Cl.
*F21V 7/05* (2006.01)
*F21K 9/232* (2016.01)
*F21K 9/68* (2016.01)

(52) U.S. Cl.
CPC ..... *F21K 9/232* (2016.08); *F21K 9/68* (2016.08)

(58) Field of Classification Search
None
See application file for complete search history.

(56) References Cited

U.S. PATENT DOCUMENTS 8,400,051 B2 3/2013 Kunihiko et al.
2012/0281403 A1 11/2012 Kang
(Continued)

FOREIGN PATENT DOCUMENTS

CN 204477743 U 7/2015
CN 104154444 B 1/2017
(Continued)

*Primary Examiner* — Elmito Breval
(74) *Attorney, Agent, or Firm* — Daniel J. Piotrowski

(57) ABSTRACT

The invention provides a lighting device (10) comprising (i) a plurality of elongated filaments (100) and (ii) an optical element (200), wherein: —each elongated filament (100) comprises a support (105) and a plurality of solid state light sources (110), wherein the elongated filament (100) has a first axis of elongation (120) having a first length (L1), wherein the elongated filament (100) is configured to generate filament light (101) over at least part of the first length (L1); and—the optical element (200) comprises a plurality of facets (210), wherein the optical element (200) has a second axis of elongation (220) having a second length (L2), wherein the optical element (200) has a non-circular cross-section perpendicular to the second axis of elongation (220), wherein the optical element (200) is configured between at least two of the plurality of elongated filaments (100), and wherein the optical element (200) is configured to redirect at least part of the filament light (101).

15 Claims, 13 Drawing Sheets

(56) References Cited

U.S. PATENT DOCUMENTS

| | | | |
|---|---|---|---|
| 2013/0286664 | A1 | 10/2013 | Wang |
| 2018/0172218 | A1 | 6/2018 | Feit |
| 2018/0216787 | A1 | 8/2018 | Chung et al. |

FOREIGN PATENT DOCUMENTS

| | | | |
|---|---|---|---|
| CN | 107917350 | A | 4/2018 |
| EP | 2827046 | A1 | 1/2015 |
| JP | 2009170759 | A | 7/2009 |
| JP | 2014500606 | A | 1/2014 |
| WO | 2011145252 | A1 | 11/2011 |

FILAMENT LAMP WITH REFLECTOR

CROSS-REFERENCE TO PRIOR APPLICATIONS

This application is the U.S. National Phase application under 35 U.S.C. § 371 of International Application No. PCT/EP2020/054142, filed on Feb. 18, 2020, which claims the benefit of European Patent Application No. 19159892.9, filed on Feb. 28, 2019. These applications are hereby incorporated by reference herein.

FIELD OF THE INVENTION

The invention relates to a lighting device.

BACKGROUND OF THE INVENTION

Filament-type of lighting devices are known in the art. U.S. Pat. No. 8,400,051 B2, for instance, describes a light-emitting device comprising: an elongated bar-shaped package with left and right ends, the package being formed such that a plurality of leads are formed integrally with a first resin with part of the leads exposed; a light-emitting element that is fixed onto at least one of the leads and that is electrically connected to at least one of the leads; and a second resin sealing the light-emitting element, wherein the leads are formed of metal, an entire bottom surface of the light-emitting element is covered with at least one of the leads, an entire bottom surface of the package is covered with the first resin, the first resin has a side wall that is integrally formed with a portion covering the bottom surface of the package and that is higher than upper surfaces of the leads, the first resin and the second resin are formed of optically transparent resin, the second resin that is filled to a top of the side wall of the first resin and that includes a fluorescent material having a larger specific gravity than that of the second resin, the leads have outer lead portions that are used for external connection and that protrude in a longitudinal direction of the package from the left and right ends wherein the fluorescent material is arranged to concentrate near the light emitting element, and is excited by part of light emitted by the light-emitting element so as to emit a color different from a color of the light emitted by the light-emitting element, and the side wall transmits part of light that is emitted by the light-emitting element and that enters the side wall and part of light emitted from the fluorescent material to the portion covering the bottom surface of the package.

US2013/286664A1 discloses a LED light bulb capable of providing even luminous intensity distribution. The LED light bulb includes a base, a light transmissive cover and upstanding light bars. The light transmissive cover is substantially mounted on the periphery. The light bars are positioned around a reflector and emit light towards the reflector. The reflector has curved side wall that reflects the light from the light bars.

EP2827046A1 discloses a LED lamp with a LED light-emitting column that comprises a high thermal conductivity tube and at least one series of LED chips disposed on an outer surface of the high thermal conductivity tube. The LED light comprises a light-transmitting bulb shell filled with a heat dissipation and protection gas, a LED driver and an electrical connector. The LED light-emitting column is fixed within the bulb shell.

SUMMARY OF THE INVENTION

Incandescent lamps are rapidly being replaced by LED based lighting solutions. It may nevertheless be appreciated and desired by users to have retrofit lamps which have the look of an incandescent bulb. For this purpose, one may make use of the infrastructure for producing incandescent lamps based on glass and replace the filament with LEDs emitting white light. One of the concepts is based on LED filaments placed in such a bulb. The appearances of these lamps are highly appreciated as they look highly decorative.

However, known solutions may not have a sufficient uniform omnidirectional light distribution.

It appears that depending on the targeted application, either the brightness of the filaments may be too high and/or the appearance of the bulb may be too static or is lacking appeal. Applying a diffusing outer bulb may reduce the brightness but may also reduce efficiency.

It appears that for an increased appeal of the lamp appearance multiple filament segments might be used. However, these may be more difficult to implement and it may be expensive to manufacture and assemble. For adjustments of the beam profile an integrated reflector may be applied, but this may not contribute to a higher appeal factor, such as a sparkle effect, and may limit the beam to a smaller beam angle.

Hence, it is an aspect of the invention to provide an alternative lighting device, which preferably further at least partly obviates one or more of above-described drawbacks. The present invention may have as object to overcome or ameliorate at least one of the disadvantages of the prior art, or to provide a useful alternative.

Amongst others, a LED lamp comprising one or more, especially a plurality, such as at least three, LED filaments adapted for, in operation, emitting LED filament light is herein suggested. In embodiments, a LED filament comprises a linear array of LEDs on an elongated substrate (or support), especially encapsulated by a luminescent material comprising material. The LED filament(s) may be arranged in an at least partly transparent envelope. The light emitting surface of the LED filament(s) are especially oriented towards a distantly arranged reflective (or refractive) element which is centrally arranged in the envelope. In embodiments, the LED filaments are evenly arranged around the reflective element. The reflective element may in embodiments have reflective surfaces for reflecting light in other directions, especially for obtaining omnidirectional distribution. In embodiments, the reflective element may be cone-shaped. In specific embodiments, the reflective element may have a double cone shape (two cone configuration). For instance, in specific embodiments the reflective element may have a double pyramid shape (two pyramid configuration). The surface area of the top pyramid may in embodiments be larger than the surface area of the bottom pyramid. In further specific embodiments, the LED filament may be chosen to emit light from only one surface facing the reflector, such as for preventing glare. The other surface may be covered by a layer (other than a phosphor), e.g. a black/metal coating, for instance to give the filament the appearance of an incandescent lamp. Hence, amongst others (also) a segmented reflector in the center of the lamp is herein suggested, with the filament(s) mounted around this reflector. In embodiments, this reflector may also act as support for the filaments and may enable feedthrough of the current conductor(s) from the top end of the filaments back to the driver or socket. By segmentation of the central reflector, multiple partial images of the filaments may become visible depending on the number of facets, their orientation, and the number and position of the filaments. By the segmentation, dynamic sparkle effects may be created as one looks at a lamp with virtual source brightness distributions that change with varying viewing position. These effects may be more or less pronounced related to the shape and size of the reflector segments (flat, concave, convex, orientation of the normal of the reflector segment relative to the filaments).

Hence, in an aspect the invention provides a lighting device comprising (i) one or more (elongated) filaments, especially a plurality of (elongated) filaments and (ii) an optical element (herein also indicated as "reflector"), wherein:

one or more of the, especially each, of the (elongated) filament (or filament light source) comprises a support and a plurality of solid state light sources, wherein the (elongated) filament may in embodiments have a first axis of elongation having a first length (L1), wherein the (elongated) filament is configured to generate filament light, especially over at least part of the first length (L1); and the optical element comprises a plurality of facets, wherein the optical element may have a second axis of elongation having a second length (L2), wherein in specific embodiments the optical element has a non-circular cross-section perpendicular to the second axis of elongation, wherein in further specific embodiments the optical element is configured between at least two of the plurality of (elongated) filaments, and wherein the optical element is configured to redirect at least part of the filament light.

The solid state light sources are arranged to generate solid state light source light. With such lighting device it may be possible to create a more omnidirectional distribution of the light. Alternatively or additionally, with such lighting device also lighting effects may be created, such as sparkle effects.

Sparkle effects may also be indicated as "pleasant glare". The boundaries between bright, glaring and sparkling luminous elements may depend on the luminance and solid angle (angular extent of the bright element with respect to the eye of the observer, or $A/R^2$, where A is the projected area of the element as seen by the observer, and R is the observer distance).

As indicated above, the invention provides (amongst others) a lighting device comprising (i) one or more filaments, especially a plurality of elongated filaments and (ii) an optical element.

Herein, the term "filament" may refer to support and a plurality of solid state light sources supported by the support and that may be arranged in a linear array. The filament may especially comprise a 1D array of solid state light sources. A 2D array of light solid state light sources may also be possible, though especially with the number of rows (n1) much smaller than the number (n2) of solid state light sources in the respective rows, such as $n1/n2 \leq 0.2$, like $n1/n2 \leq 0.1$, especially $n1/n2 \leq 0.05$. In specific embodiments, the support supports a (1D) array of solid state light sources at one side of the support, and optionally another (1D) array of solid state light sources at the other side of the support. Preferably, the filament has a length L and a width W, wherein $L>5W$. The filament may be arranged in a straight configuration or in a non-straight configuration such as for example a curved configuration, a 2D/3D spiral or a helix. Preferably, the solid state light sources are arranged on an elongated carrier like for instance a substrate, that may be rigid (made from e.g. a polymer, glass, quartz, metal or sapphire) or flexible (e.g. made of a polymer or metal e.g. a film or foil). In case the carrier comprises a first major surface and an opposite second major surface, the solid state light sources are arranged on at least one of these surfaces. The carrier may be reflective or light transmissive, such as translucent and preferably transparent. The filament may comprise an encapsulant at least partly covering at least part of the plurality of solid state light sources. The encapsulant may also at least partly cover at least one of the first major or second major surface. The encapsulant may be a polymer material which may be flexible such as for example a silicone. Further, the solid state light sources may be arranged for emitting solid state light source light e.g. of different colors or spectrums. The encapsulant may comprise a luminescent material that is configured to at least partly convert solid state light source light into converted light. The luminescent material may be a phosphor such as an inorganic phosphor and/or quantum dots or rods. The filament may comprise multiple sub-filaments.

The support may in embodiments have a thickness of 0.05-4 mm, such as 0.05-1 mm, like 0.1-0.5 mm. The support may have a width of 0.1-5 mm, such as 0.2-3 mm, like 0.3-2 mm. The length of the support (and thus in embodiments essentially the length of the filament), herein also indicated as first length (L1), may in embodiments e.g. be selected from the range of 10-500 mm, such as 15-200 mm, like in the range of 20-100 mm, such as in the range of 25-80 mm, for example 40 or 50 mm. Hence, the support (and thus essentially also the filament) may have relative high aspect ratios (length/width or length/thickness), such as at least 10, even more especially at least 15, such as at least 20, like even more especially at least 50. Large aspect ratios may better mimic a filament.

The support may e.g. comprise glass or sapphire. In other embodiments, the support may comprise a polymeric material. As also indicated below, the support may be rigid (self-supporting), but may (in polymeric embodiments) also be flexible. The first length is especially the length along the axis of elongation.

In embodiments, the support may be translucent. In other embodiment, the support may be transparent. Hence, the material of the support may be translucent or transparent for light, especially visible light. For transparent materials, see also below.

The elongated filament may have a straight axis of elongation, when the elongated filament is straight. However, the elongated filament may also—in embodiments—include a plurality of segments, of which two or more may be configured under an angle 180°; ≠0°) relative to one another. Alternatively or additionally, the elongated filament may include one or more curvatures, for instance a curved segment, or two segments that are configured under an angle and which are connected via a curved segment. Hence, in embodiments the axis of elongation may also include one or more curvatures and/or one or filament segments that are configured under an angle (≠180°) relative to one another. Hence, the filament may comprise a single segment, or may comprise a plurality of segments (with each segment comprising one or more solid state light sources). Especially, herein the elongated filaments are essentially straight filaments. The one or more filaments may in embodiments be self-supporting (straight) filaments (see also above).

The term "light source" may refer to a semiconductor light-emitting device, such as a light emitting diode (LEDs), a resonant cavity light emitting diode (RCLED), a vertical cavity laser diode (VCSELs), an edge emitting laser, etc. The term "light source" may also refer to an organic light-emitting diode, such as a passive-matrix (PMOLED), or an active-matrix (AMOLED). In specific embodiments, the light source comprises a solid state light source (such as a LED or laser diode). In embodiments, the light source comprises a LED (light emitting diode). The term "LED" may also refer to a plurality of LEDs. Further, the term "light source" may in embodiments also refer to a so-called chips-on-board (COB) light source. The term "COB" especially refers to LED chips in the form of a semiconductor chip that is neither encased nor connected but directly mounted onto a substrate, such as a PCB. Hence, a plurality of semiconductor light sources may be configured on the same substrate. In embodiments, a COB is a multi LED chip configured together as a single lighting module. The term "light source" may also relate to a plurality of (essentially identical (or different)) light sources, such as 2-2000 solid state light sources. In embodiments, the light source may comprise one or more micro-optical elements (array of micro lenses) downstream of a single solid state light source, such as a LED, or downstream of a plurality of solid state light sources (i.e. e.g. shared by multiple LEDs). In embodiments, the light source may comprise a LED with on-chip optics. In embodiments, the light source comprises a pixelated single LEDs (with or without optics) (offering in embodiments on-chip beam steering).

The phrases "different light sources" or "a plurality of different light sources", and similar phrases, may in embodiments refer to a plurality of solid state light sources selected from at least two different bins. Likewise, the phrases "identical light sources" or "a plurality of same light sources", and similar phrases, may in embodiments refer to a plurality of solid state light sources selected from the same bin.

It may also be possible that the light source light of the solid state light sources at one side of the support has another spectral distribution and/or intensity than the light source light of the solid state light sources at another side of the support (in embodiments wherein solid state light sources are available at both sides of the support).

Alternatively or additionally, it may be that the spectral distribution of the filament light varies along the length of the filament (at one side or at both sides).

An example of a suitable elongated light source is described in U.S. Pat. No. 8,400,051 B2, which is herein incorporated by reference.

Hence, in embodiments the elongated light source may comprise a first light-emitting device comprising: an elongated bar-shaped package extending sideways, the package being formed such that a plurality of leads are formed integrally with a first resin with part of the leads exposed; a light-emitting element that is fixed onto at least one of the leads and that is electrically connected to at least one of the leads; and a second resin sealing the light-emitting element, characterized in that the first resin and the second resin are formed of optically transparent resin, and the leads have outer lead portions used for external connection and protruding sideways from both left and right ends of the package.

In yet embodiments, the elongated light source may comprise a first light-emitting device comprising: an elongated package being formed such that a plurality of leads are formed integrally with a first resin; a plurality of light-emitting elements that are fixed onto at least one of the leads and that are electrically connected to at least one of the leads; and an optically transparent second resin sealing the light-emitting elements, wherein the first resin includes side walls which are higher than upper surfaces of the leads, and an entire lower surface of the package is covered with the first resin; and wherein the leads are formed of a metal material and part of the leads have outer lead portions used for external connection which protrude from both ends of the package in longitudinal direction, characterized in that the first resin is formed of optically transparent resin.

In an embodiment, the elongated filament comprises luminescent material configured to convert at least part of the solid state light source light into luminescent material light and wherein the filament light comprises the luminescent material light and optionally solid state light source light.

In yet other embodiments, the elongated light source may comprise a first light-emitting device comprising: an elongated bar-shaped package with left and right ends, the package being formed such that a plurality of leads are formed integrally with a first resin with part of the leads exposed; a light-emitting element that is fixed onto at least one of the leads and that is electrically connected to at least one of the leads; and a second resin sealing the light-emitting element, wherein the leads are formed of metal, an entire bottom surface of the light-emitting element is covered with at least one of the leads, an entire bottom surface of the package is covered with the first resin, the first resin has a side wall that is integrally formed with a portion covering the bottom surface of the package and that is higher than upper surfaces of the leads, the first resin and the second resin are formed of optically transparent resin, the second resin that is filled to a top of the side wall of the first resin and that includes a luminescent material having a larger specific gravity than that of the second resin, the leads have outer lead portions that are used for external connection and that protrude in a longitudinal direction of the package from the left and right ends wherein the luminescent material is arranged to concentrate near the light emitting element, and is excited by part of light emitted by the light-emitting element so as to emit a color different from a color of the light emitted by the light-emitting element, and the side wall transmits part of light that is emitted by the light-emitting element and that enters the side wall and part of light emitted from the luminescent material to the portion covering the bottom surface of the package.

Further, in embodiments the second resin includes luminescent material. Especially, in embodiments the first light-emitting device may comprise: a plurality of first light-emitting devices as described above; a filament including these light-emitting devices; and power supply leads electrically connected to the filament, wherein the filament is so configured that adjacent ones of outer lead portions are firmly attached and connected in series such that adjacent ones of the light-emitting devices are V-shaped, and both ends of the outer lead portions connected in series are firmly attached to the power supply leads.

Such type of elongated light sources, wherein a plurality of solid state light sources are configured on a support with a resin including luminescent material configured around at least part of the plurality of LEDs are known in the art as (embodiments of) LED filaments. They may generate white light, due to the combination of e.g. blue emitting solid state light sources and a luminescent material, such as a cerium comprising garnet, that is configured to convert part of the blue light into yellow light, thereby providing white light. Of course, also other combinations of light sources and luminescent materials may be chosen, such as blue solid state light source light with yellow and red luminescing luminescent material(s); blue solid state light source light with green and red luminescing luminescent material(s); UV solid state light source light with blue, green and red luminescing luminescent material(s). Further luminescent materials may also be applied in any of the suggested combinations, such as cyan and/or amber luminescent materials.

In embodiments, the filament may comprise a substrate (which is an embodiment of a support) having an elongated body with an extension along an elongation axis, a plurality of solid state light sources, such as LEDs, mechanically coupled to the substrate, and wiring for powering the plurality of LEDs.

Further, also different types of solid state light sources may be applied (optionally in embodiments at different sides of the support; see also above). For instance, the blue emitting solid state light sources may be applied in combination with one or more of cyan light emitting solid state light sources and amber light emitting solid state light sources. The cyan light emitting solid state light sources and amber light emitting solid state light sources, respectively, may be obtained with using the same type of solid state light source used for generating the blue solid state light source light, but in combination with a specific luminescent material.

Therefore, in embodiments the elongated light source comprises a LED filament, wherein the elongated light source comprises luminescent material configured to convert at least part of the solid state light source light into luminescent material light, wherein the light source light comprises the luminescent material light and optionally solid state light source light.

The term "luminescent material" may thus also refer to a plurality of different luminescent materials.

Hence, in general the filament light will have a spectral distribution with a plurality of wavelengths, such as is the case with the blue light of a blue LED or with the yellow light of a trivalent cerium comprising garnet based luminescent material or many $Eu^{2+}$ based luminescent material.

In embodiment, the elongated light source is configured to generate white light. The term white light herein, is known to the person skilled in the art. It especially relates to light having a correlated color temperature (CCT) between about 2000 and 20000 K, especially 2700-20000 K, for general lighting especially in the range of about 2700 K and 6500 K, and especially within about 15 SDCM (standard deviation of color matching) from the BBL (black body locus), especially within about 10 SDCM from the BBL, even more especially within about 5 SDCM from the BBL.

In embodiments, the light source may also provide light source light having a correlated color temperature (CCT) between about 5000 and 20000 K, e.g. direct phosphor converted LEDs (blue light emitting diode with thin layer of phosphor for e.g. obtaining of 10000 K). Hence, in a specific embodiment the light source is configured to provide light source light with a correlated color temperature in the range of 5000-20000 K, even more especially in the range of 6000-20000 K, such as 8000-20000 K. An advantage of the relative high color temperature may be that there may be a relative high blue component in the light source light.

Therefore, in embodiments each elongated filament comprises a support and a plurality of solid state light sources (at one or at both sides of the support). The solid state light sources are especially configured to generate solid state light source light. In embodiments, this light source light may at least partly be converted into luminescent material light by a luminescent material. Hence, the filament light generated by the filament may comprise one or more of solid state light source light and luminescent material light, especially in embodiments both. Note that in embodiments the spectral distribution of the filament light may vary over the length of the filament and/or depend upon the side of the filament.

Hence, the elongated filament has a first axis of elongation having a first length (L1), wherein the elongated filament is configured to generate filament light over at least part of the first length (L1). For instance, over at least 70% of its length, especially at least 80% of its length, even more especially at least 90%, such as yet even more especially at least 95%, such as at least 98% of its length, filament light may be generated. In general, over essentially the entire length of the filament light may be generated, such that the filament is perceived as a (classical) filament.

The solid state light sources may have a pitch selected from the range of 0.3-3 mm.

In specific embodiments, solid state light sources are only available at one side of the support. In such embodiments, the filament may essentially not be a radial emitter (radial with respect to the first axis of elongation). In other embodiments, solid state light sources are only available at both sides of the support. In such embodiments, the filament may essentially be a radial emitter (radial with respect to the first axis of elongation).

In order to redistribute at least part of the filament light, the optical element is provided.

In specific embodiments, the optical element may comprise a plurality of facets.

The optical element has a second axis of elongation having a second length (L2). When the filaments are not slanted and not curved, the length of the first axis of elongation and the second axis of elongation may in embodiments approximately be the same, such as $0.9 \leq L1/L2 \leq 1.1$.

In embodiments, each facet may have a facet area selected from the range of 0.5-20 $cm^2$, such as especially 1-20 $cm^2$, like more especially 1-10 $cm^2$, such as in embodiments 1.5-10 $cm^2$, like in further embodiments 2-8 $cm^2$. However, other dimensions may also be possible.

The phrase "a plurality of facets" may refer to a plurality of facets along the length of the second axis of elongation of the optical element. The phrase "a plurality of facets" may also refer to a plurality of facets along a dimension perpendicular to the length of the second axis of elongation of the optical element. For instance, a cylindrical optical element may have a single facet, a cone may have a single facet, a double cone may have two facets, a triangular pyramid (regular tetrahedron) may have three facets (assuming a bottom facet perpendicular to the second axis of elongation), and a double triangular pyramid may have six facets (assuming the bottom facets perpendicular to the second axis of elongation), etc. etc.

Adjacent facets may have mutual facet angles ($\alpha 1$), which are especially unequal to 0° (and unequal to 180°). For instance, in the case of a regular tetrahedron, the facets may have facet angles $\alpha 1 = 60°$.

The optical element is especially configured to redirect at least part of the filament light. Hence, the optical element may have one or more properties selected from the group consisting of reflection, refraction, and scattering. In this way, the optical element may have reflective properties.

For instance, in embodiments the optical element may comprise a light transparent material, and due to the presence of the facets, light may refract at the facets. In this way, the optical element may be configured to redirect at least part of the filament light (by refraction at the facets). For instance, in embodiments visible light propagating in a direction perpendicular to the second axis of elongation may meet one or more facets, configured such that visible light is refracted.

Hence, in specific embodiments the optical element may be a light transparent body essentially consisting of a light transmissive material (that is especially transparent).

The light transmissive material may comprise one or more materials selected from the group consisting of a transmissive organic material, such as selected from the group consisting of PE (polyethylene), PP (polypropylene), PEN (polyethylene napthalate), PC (polycarbonate), polymethylacrylate (PMA), polymethylmethacrylate (PMMA) (Plexiglas or Perspex), cellulose acetate butyrate (CAB), silicone, polyvinylchloride (PVC), polyethylene terephthalate (PET), including in an embodiment (PETG) (glycol modified polyethylene terephthalate), PDMS (polydimethylsiloxane), and COC (cyclo olefin copolymer). Especially, the light transmissive material may comprise an aromatic polyester, or a copolymer thereof, such as e.g. polycarbonate (PC), poly (methyl)methacrylate (P(M)MA), polyglycolide or polyglycolic acid (PGA), polylactic acid (PLA), polycaprolactone (PCL), polyethylene adipate (PEA), polyhydroxy alkanoate (PHA), polyhydroxy butyrate (PHB), poly(3-hydroxybutyrate-co-3-hydroxyvalerate) (PHBV), polyethylene terephthalate (PET), polybutylene terephthalate (PBT), polytrimethylene terephthalate (PTT), polyethylene naphthalate (PEN); especially, the light transmissive material may comprise polyethylene terephthalate (PET). Hence, the light transmissive material is especially a polymeric light transmissive material. However, in another embodiment the light transmissive material may comprise an inorganic material. Especially, the inorganic light transmissive material may be selected from the group consisting of glasses, (fused) quartz, transmissive ceramic materials, and silicones. Also hybrid materials, comprising both inorganic and organic parts may be applied. Especially, the light transmissive material comprises one or more of PMMA, transparent PC, or glass.

In yet another embodiment, the optical element may be configured to specularly reflect the filament light. To this end, the facets may be provided with specular mirrors, such as Al mirrors. In this way, the optical element may be configured to redirect at least part of the filament light (by specular reflection at the facets). For instance, in embodiments visible light propagating in a direction perpendicular to the second axis of elongation may meet one or more facets, configured such that visible light is reflected.

Hence, in embodiments the optical element is configured to redirect at least part of the filament light by one or more of reflection at a facet and refraction at a facet. Hence, the optical element may have both refractive and reflective properties.

In yet other embodiments, the optical element may be configured to diffusively reflect the filament light. To this end, the facets may comprise scattering structures, such as a white coating with roughness selected to scatter the filament light. Alternatively or additionally, the optical element may comprise a light transparent material, with at the facets and/or embedded in the body scattering features.

Scattering features at the facets may be roughness of the surface; scattering features in the body may be (scattering) particles, such as having particle sizes in the order of the wavelength of the light or larger. Suitable transparent materials are indicated above; suitable scattering particles may be particles or bead or other shapes within a body of light transmissive material, wherein the scattering particles have an index of refraction different from the light transmissive material. Such particles may thus comprise light reflective material, but may also comprise light transmissive material having an index of refraction different from the body of light transmissive material. Suitable reflective materials for reflection in the visible may be selected from the group consisting of $TiO_2$, $BaSO_4$, MgO, $Al_2O_3$, and Teflon. Herein, the term "diffuse reflective" may e.g. imply that under perpendicular radiation of a material that is diffuse reflective (or has a diffuse reflective surface) with light, especially visible light, such as white light or blue light, less than 20%, such as less than 10%, like in the range of 10-0.1%, even more especially in the range of 5-0.1%, or even below 1%, may be specularly reflected. All other light that is reflected (at the surface or optionally in the bulk), is (essentially) diffusively reflected. Hence, in embodiments the optical element is configured to redirect at least part of the filament light by diffuse reflection.

Combinations of above embodiments may also be possible, such in embodiments the optical element comprising parts, wherein for each part may apply that the redirection of the filament light is based on at least one of refraction, (specular) reflection, and scattering, and wherein in embodiments different parts may redirected filament light on the basis of different principles (of these three principles).

In specific embodiments, the optical element may be configured to redirect at least 10% of the filament light. In yet further specific embodiments, the filament(s) and optical element are configured such, that equal to or less than 90% of the filament light is redirected. However, in other embodiments, all filament light may be redirected, e.g. to reduced glare. However, in yet other embodiments, the optical element (and filament(s)) is (are) configured to redirect in the range of 10-90%, such as 15-80%, of the filament light. In yet other embodiments, the optical element (and filament(s)) is (are) configured to redirect 15-45%, such as 20-40%, of the filament light.

In specific embodiments, the lighting device may comprise a plurality of elongated filaments. Especially, in such embodiments the optical element and the elongated filaments may be symmetrically arranged.

Especially, in embodiments the second axis of elongation may (essentially) coincide with an n-fold axis of rotation for n elongated filaments, like a three-fold rotation axis in the case of three filaments, a four-fold rotation axis in the case of four filaments, etc. In embodiments, the second axis of elongation may be configured in one or more mirror planes (of the filaments). Hence, in embodiments the optical element is configured between at least two of the plurality of elongated filaments.

In yet other embodiments, the elongated filament(s) comprises one or more curves, and may circumfere the optical element.

In specific embodiments, the optical element has a non-circular cross-section perpendicular to the second axis of elongation. Especially, this may be useful for redirecting the filament light. Embodiments with a circular cross-section of the optical element appear to lead to more glare than embodiments of the optical element with a non-circular cross-section. Further, a sparkling effect may be weaker or absent in the case of the circular cross-section, but (stronger) present for optical elements with a non-circular cross-section.

In embodiments, the optical element may have a cross-section (perpendicular to the second axis of elongation) having a shape selected from the group of oval, triangle, square, rectangular, pentagonal, hexagonal, etc., such as up to about 24 facets, like up to about 12 facets surrounded along the second axis of elongation.

In embodiments, the optical element may comprise 2-100 facets, such as 2-50 facets, such as 2-20. In embodiments, the optical element may comprises 3-12 facets, like 3-8 facets, such as 4-7 facets, like e.g. 5 or 6 facets. However, much more, even over 100 facets, may also be possible. Hence, in specific embodiments the optical element may have at a height along the first length 3-12 facets, i.e. the optical element may have a cross-section (perpendicular to the second axis of elongation) having a 3-12 facets.

In embodiments, two or more facets of the optical element (unit) may circumferentially surround the second axis of elongation. The facets may be configured symmetrically around the second axis of elongation. For instance, the second facets may be configured such that one or more symmetry planes are provided, wherein especially the second axis of elongation is in the one or more symmetry planes.

The facets may thus be part of a hollow body or a massive body. Facets at the same height may form a unit. The unit may be massive or hollow, such as a massive body of one or more the above-indicated light transmissive materials, or a hollow body comprising one or more reflective (and/or transmissive) faces.

The optical element may include a single unit, such as e.g. a hexagonal shaped cylinder or a regular tetrahedron. However, in embodiments the optical element may comprise a stack of two or more of such units, herein also indicated as "optical element units".

Hence, in embodiments the optical element may comprise one or more optical element units, wherein each optical element unit comprises one or more of the plurality of facets. Especially, one or more of the optical element units may be comprised by the optical element, wherein optical element unit may comprise at least two facets, such as an oval (cross-section) with two facets, or three facets, such as a trigonal cylinder, or four facets, such as a regular pyramid, etc.

It further appears to be beneficial when the filament and closest facet(s) may be configured such that e.g. not all possible mirror planes of symmetry for the facet (essentially) coincide with planes of symmetry of the filament(s).

For instance, the filament may be configured tilted relative to the (closest) facet(s). A tilt of the filament relative the facet may include one or more of a tilt in a plane parallel to the facet and a tilt in a plane perpendicular to the facet.

Alternatively or additionally, a normal to the facet may not intersect with the filament. For instance, this may e.g. in specific embodiments be obtained when the filament is configured tilted relative to the facet or translated relative a normal to the facet.

Therefore, in embodiments for one or more of the facets of the optical element unit applies that a facet normal configured perpendicular to the facet complies with one of the conditions selected from (i) the facet normal does not intersect with an adjacent elongated filament, and (ii) the facet normal and the axis of elongation of an adjacent elongated filament have a mutual angle ($\beta 1$) unequal to 90°.

The term "facet normal" especially refers to a normal to the facet at a position of a centroid of the facet. A centroid of the facet is the arithmetic mean position of all the points in the facet. It can be considered the point at which a cutout of the shape could be perfectly balanced on the tip of a pin.

As indicated above, the optical element may comprise a one or more of the optical element units. As also indicated above, a slanted elongated filament and/or a (differently) slanted facet (that reflects at least part of the filament light of the (slanted) elongated filament) may also be useful for improving the spatial distribution of the light. For instance, in embodiments the facet(s) of such unit may taper in a direction along the second axis of elongation. Hence, in specific embodiments the optical element may comprise one or more optical element units, wherein in specific embodiments one or more, especially each optical element unit, comprises one or more of the plurality of facets, wherein the one or more facets of the optical element unit are especially symmetrically configured relative to the second axis of elongation, and wherein in specific embodiments the one or more facets of the optical element unit taper in a direction parallel to the axis of elongation.

In embodiments, the optical element may comprise an ensemble of optical element units, which are stacked.

In embodiments the optical element comprises one or more optical element units, wherein each optical element unit comprises at least two facets, wherein the at least two facets are symmetrically configured relative to the second axis of elongation, and wherein the facets taper in a direction parallel to the axis of elongation.

Further beneficial for the omni-directionality may be when two or more optical element units have different taper directions, especially opposite taper directions (along the second axis of elongation). For instance, two pyramids may be used, sharing a base. However, also a stack of e.g. four or more tapering optical element units may be used. Therefore, in embodiments the lighting device may comprise one or more sets, wherein each set comprises two adjacently configured optical element units, wherein the optical element units within the set taper in opposite directions (along the second axis of elongation).

In embodiments, wherein the optical element units taper in opposite directions, the shapes of the optical element units can be the same, and thus the taper may also be the same. However, the shapes of the optical element units (within a set) may also be different. In specific embodiments, the tapering may be different, such as the same type of shapes for both the optical element units, but different taperings. Hence, in embodiments, the length of the optical element units along the second axis of elongation may differ for the two optical element units. When the length is shorter, the tapering is relatively stronger, and vice versa. When the tapering differs, in embodiments the surface area of the top optical element unit, such as a pyramid, may in be larger than the surface area of the bottom optical element unit, such as a pyramid (or the other way around).

In a specific embodiment, a single set is applied, wherein in specific embodiments the tapering of the sets is in the direction of the ends of the optical element (e.g. the aforementioned two pyramids may be used, sharing a base). This may provide in embodiments that the facets redirect filament light in a direction having a component parallel to the second axis of elongation (more precisely, in two opposite directions). Especially, in such embodiment, a tapering in the direction of a base (see also below), may be stronger, than a tapering in a direction of the other end of the lighting device (i.e. pointing away from the base).

Two (or more) adjacent optical element units may form in embodiments a single body. Alternatively, two adjacent optical element units may be provided by two (different) bodies. Other embodiments may also be possible. Hence, a single optical element may comprise a plurality of optical element units. More especially, a single optical element body may comprise a plurality of optical element units.

In yet other embodiments, the lighting device, especially the optical element, may comprise a plurality of the sets. The sets may be stacked. Hence, in embodiments the optical element comprises a stack of sets of optical element units. As indicated above, in embodiments the stack may be a single body.

In specific embodiments, the first axes of elongation of the respective elongated filaments are configured parallel to the second axis of elongation. In such embodiments, the filaments are configured parallel to the optical element (or at least its axis of elongation). As indicated above, the filaments are especially configured symmetrically relative to the second axis of elongation.

In embodiments, the optical element comprises one or more optical element units, wherein each optical element unit comprises two or more of the plurality of facets, wherein two or more of the two or more facets circumferentially surround the second axis of elongation, wherein adjacent facets define a facet edge. In further specific embodiments, one or more filaments may be configured with their first axis of elongation parallel to one or more of the facet edges. In yet further embodiments, one or more filaments are configured closest to a respective facet edge, and each facet (of the optical element unit) is configured at a larger distance from the respective filament than the respective facet edge. In such embodiments, a normal to a facet, especially to the centroid of the facets closest to the filament may not intersect the filament. As indicated above, in specific embodiments one or more of the one or more optical element units each comprise 3-12 facets. However, other embodiments of the number of facets are also possible (see e.g. above).

Therefore, in specific embodiments one or more of the facet edges, one or more of the first axes of elongation, and the second axis of elongation, are configured in a plane.

In (other) embodiments, as also indicated above, one or more of the plurality of first axes of elongation are slanted relative to the second axis of elongation. In yet further specific embodiments, the slanting is chosen such that the first axes of elongation of one or more of the filaments are not in a same plane with the second axis of elongation.

In specific embodiments, one or more of the facets of the optical element are planar. In further specific embodiments, all facets of the optical element are planar.

In (other) embodiments, one or more of the facets (of the optical element) are concave. In further specific embodiments, all facets of the optical element are concave. The term "concave" indicates that the facet is hollow when viewed from the closest arrange filament and/or is convex when viewed from the second axis of elongation. With concave facets, filament light may also be redirected to improve omni-directionality of the filament light of the lighting device.

In (other embodiments), one or more of the facets (of the optical element) are convex. In further specific embodiments, all facets of the optical element are convex.

In embodiments, parts of facets may be concave and other parts of (the respective) facets may be convex. Further, in embodiments wherein a cross-section with the optical elements shows that there are at least two facets (i.e. not a single facet as may be the case when the optical element would have a circular cross-section), those facets may be concave or convex. In specific embodiments, there may be one or more facets, wherein each facet comprises a plurality of convex parts, or a plurality of concave parts, or one or more convex parts and one or more concave parts.

In embodiments (see also above), only one side of a filament may provide filament light. For instance, this may be used to reduce glare. Hence, in embodiments one or more of the plurality of elongated filaments is configured to provide more filament light in the direction of the optical element than in opposite directions.

In embodiments, the spectral distribution of the filament light generated at one side of the filament may be different from the filament light generated at the other side of the filament. This may be used for creating specific effects. This may also be used to control the spectral distribution of the lighting device light.

In embodiments, a configuration of a single optical element configured between two or more filaments may be provided. In other embodiments, a configuration of a plurality of optical elements configured between two or more filaments may be provided. In yet further embodiments, a plurality of sets is provided, wherein each set comprises a single optical element configured between two or more filaments.

In further embodiments, multiple optical elements may be provided that may be located around the central optical axis of the system (or with their center of gravity located on the central optical axis of the system). These two or more optical elements may be mounted parallel or may make an angle ($\neq 0°$ or $\neq 180°$) with respect to each other.

As indicated above, with filaments a retro type of lamp may be provided, including a light transmissive bulb, and even when desired including a pump stem. For instance, the optical element may be attached to the pump stem.

Hence, the term "lighting device" may also refer to a lamp, especially a lamp with a light transmissive bulb wherein the one or more filaments and the optical element are configured.

The lighting device may have a lighting device axis or axis of elongation. For instance, the outer shape of the lighting device may essentially be symmetrical, with a rotational axis and/or one or more planes of symmetry, like many conventional light bulbs. In specific embodiments, the second axis of elongation may essentially coincide with a lighting device axis or axis of elongation.

In embodiments the lighting device may comprise (i) a base, and (ii) an outer bulb, together defining an enclosure enclosing the plurality of elongated filaments and the optical element, wherein the solid state light sources comprise LEDs, and wherein in specific embodiments the elongated filaments are straight elongated elements.

In embodiments, the optical element may further be configured to be a support for the filaments. In embodiments, the optical element may further be configured to enable feedthrough of one or more current conductor(s) from the top end of the filament(s) back to the driver or socket. The driver may be comprised by the base.

Especially, the lighting device is a retrofit lamp.

In embodiments, the lighting device may be included in or constitute a LED bulb or retrofit lamp which is connectable to a lamp or luminaire socket by way of some appropriate connector. For example an Edison screw, a bayonet fitting, or another type of connector suitable for the lamp or luminaire known in the art. The connector may be connected to a base portion, to which the elongated filament(s) and the optical element may be functionally coupled.

The lighting device may comprise a control system, such as e.g. at least partly comprised by the base. The control system may be configured to control one or more of intensity of the filament light, intensity of the light source light of individual light sources or sets of light sources, color point, color temperature, etc.

The term "controlling" and similar terms especially refer at least to determining the behavior or supervising the running of an element. Hence, herein "controlling" and similar terms may e.g. refer to imposing behavior to the element (determining the behavior or supervising the running of an element), etc., such as e.g. measuring, displaying, actuating, opening, shifting, changing temperature, etc. Beyond that, the term "controlling" and similar terms may additionally include monitoring. Hence, the term "controlling" and similar terms may include imposing behavior on an element and also imposing behavior on an element and monitoring the element. The controlling of the element can be done with a control system, which may also be indicated as "controller". The control system and the element may thus at least temporarily, or permanently, functionally be coupled. The element may comprise the control system. In embodiments, the control system and element may not be physically coupled. Control can be done via wired and/or wireless control. The term "control system" may also refer to a plurality of different control systems, which especially are functionally coupled, and of which e.g. one control system may be a master control system and one or more others may be slave control systems. A control system may comprise or may be functionally coupled to a user interface.

The control system may also be configured to receive and execute instructions form a remote control. In embodiments, the control system may be controlled via an App on a device, such as a portable device, like a Smartphone or I-phone, a tablet, etc. The device is thus not necessarily coupled to the lighting device, but may be (temporarily) functionally coupled to the lighting device.

Hence, in embodiments the control system may (also) be configured to be controlled by an App on a remote device. In such embodiments the control system of the lighting device may be a slave control system or control in a slave mode. For instance, the lighting device may be identifiable with a code, especially a unique code for the respective lighting device. The control system of the lighting device may be configured to be controlled by an external control system which has access to the lighting device on the basis of knowledge (input by a user interface of with an optical sensor (e.g. QR code reader) of the (unique) code. The lighting device may also comprise means for communicating with other systems or devices, such as on the basis of Bluetooth, Wifi, ZigBee, BLE or WiMax, or another wireless technology.

Hence, in embodiments, the control system may control in dependence of one or more of an input signal of a user interface, a sensor signal (of a sensor), and a timer. The term "timer" may refer to a clock and/or a predetermined time scheme.

The lighting device may be part of or may be applied in e.g. office lighting systems, household application systems, shop lighting systems, home lighting systems, accent lighting systems, spot lighting systems, theater lighting systems, fiber-optics application systems, projection systems, self-lit display systems, pixelated display systems, segmented display systems, warning sign systems, medical lighting application systems, indicator sign systems, decorative lighting systems, portable systems, automotive applications, (outdoor) road lighting systems, urban lighting systems, green house lighting systems, horticulture lighting, etc.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily to scale.

DETAILED DESCRIPTION OF THE EMBODIMENTS

It appears appreciated and desired by users to have a retrofit lamp which has the look of an incandescent bulb. For this purpose, one can simply make use of the infrastructure for producing incandescent lamps based on glass and replace the filament with LEDs emitting white light.

Figure 1A:
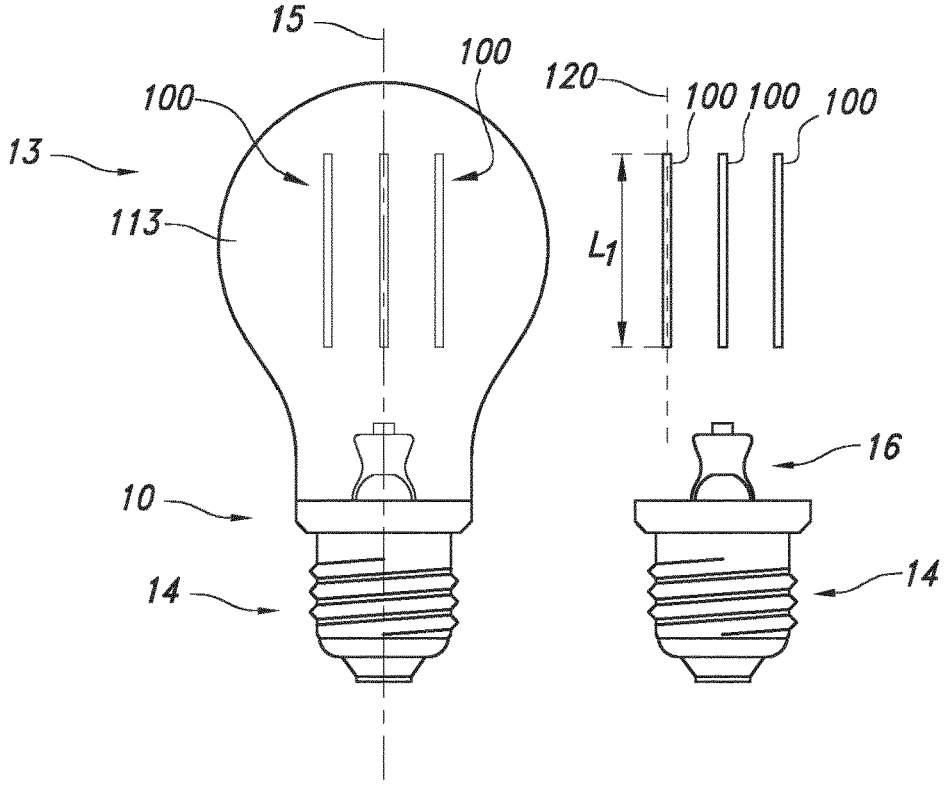
FIGS. 1*a*-1*b* schematically depicts a retrofit lamp, without an optical element, and an associated intensity distribution.
Figure 1B:
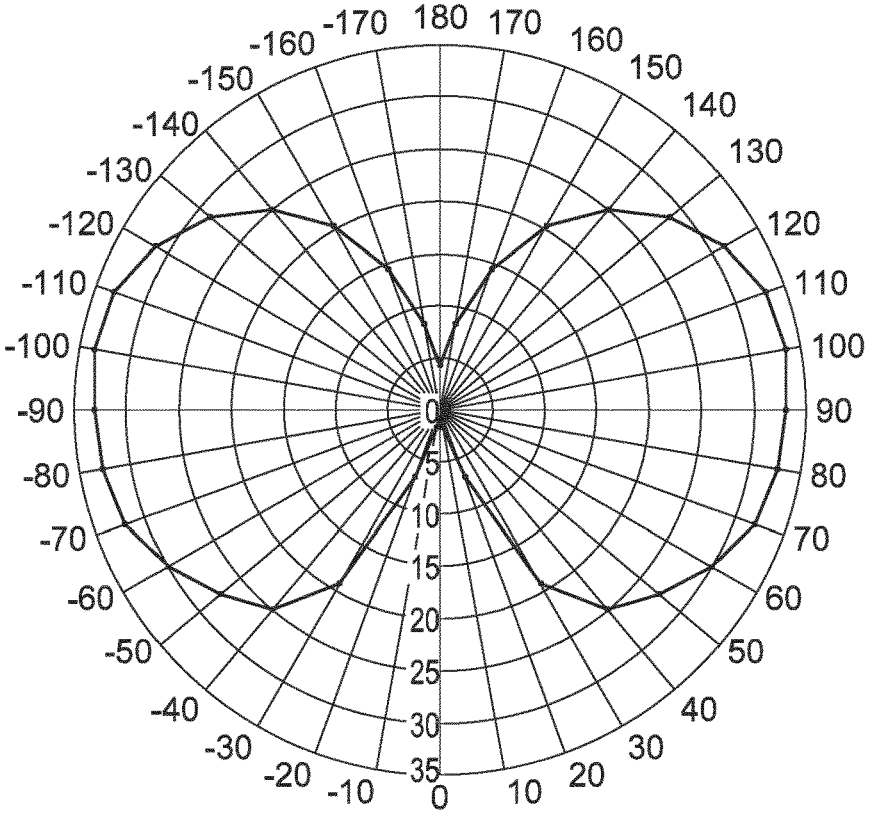

One of the concepts is based on LED filaments placed in such a bulb. The appearances of these lamps are highly appreciated as they look highly decorative. FIGS. 1*a*-1*b* schematically depicts a retrofit lamp, without an optical element, and an associated intensity distribution. However, such solution may not provide omnidirectional light distribution. FIG. 1*b* shows that there is (almost) no light is going up and downwards (downward light is also partly screened by lamp base.)

Amongst others, a LED lamp comprising one or more, especially a plurality, such as at least three LED filaments (i.e. a linear array of LEDs on an elongated substrate preferably encapsulated by a luminescent material) adapted for, in operation, emitting LED filament light is herein suggested. The LED filaments may be arranged in an at least partly transparent envelope. The light emitting surface of the LED filaments are especially oriented towards a distantly arranged reflective (or refractive) element which is centrally arranged in the envelope. In embodiments, the LED filaments are evenly arranged around the reflective element. The reflective element may in embodiments have reflective surfaces for reflecting light in other directions for obtaining omnidirectional distribution.

In embodiments, the reflective element may be cone-shaped. In specific embodiments, the reflective element may have a double cone shape (two cone configuration). For instance, in specific embodiments the reflective element may have a double pyramid shape (two pyramid configuration). The surface area of the top pyramid may in embodiments be larger than the surface area of the bottom pyramid.

In further specific embodiments, the LED filament may be chosen to emit light from only one surface facing the reflector preventing glare. The other surface may be covered by a layer (other than a phosphor), e.g. a black/metal coating, for instance to give the filament the appearance of an incandescent lamp. Further, amongst others (also) a segmented reflector in the center of the lamp is herein suggested, with the filaments mounted around this reflector. This reflector may also act as support for the filaments and may enable feedthrough of the current conductor(s) from the top end of the filaments back to the driver or socket.

FIG. 1*a* shows an embodiment of a lighting device 10 (but without optical element) comprising (i) a base 14, and (ii) an outer bulb 13. The outer bulb together with the base may define an enclosure 113 enclosing the plurality of elongated filaments 100 and the optical element (not depicted). Here, in this schematically depicted embodiment the elongated filaments 100 are straight elongated elements 100. The lighting device 10 has a device axis or (device) axis of elongation 15. The device 10 is essentially rotationally symmetry around this axis 15 and/or comprises one or more (here in fact a plurality) of symmetry planes, which each comprise the device axis of elongation 15. Reference 16 indicates an optional pump stem. The same device 10 without outer bulb 13 is depicted at the right side of FIG. 1*a*.

FIG. 1*a* is further explained below after a short introduction of FIG. 2*a*. FIG. 1*b* shows the intensity distribution. As shown, upwards and downwards, the intensity is relatively low. The intensity distribution has a kind of donut shape.

Figure 2A:
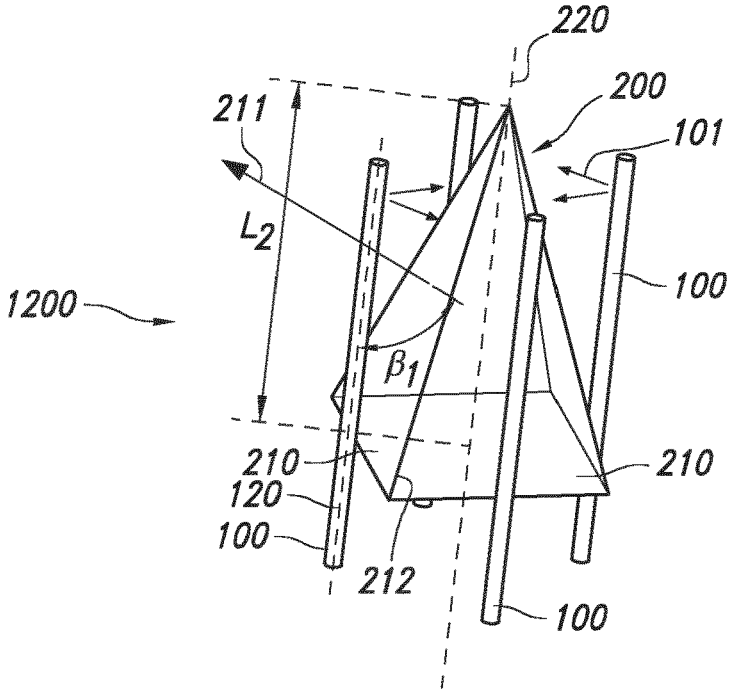
FIGS. 2*a*-2*b* schematically depicts an embodiment of such retrofit lamp with an optical element, and an associated intensity distribution.
Figure 2B:
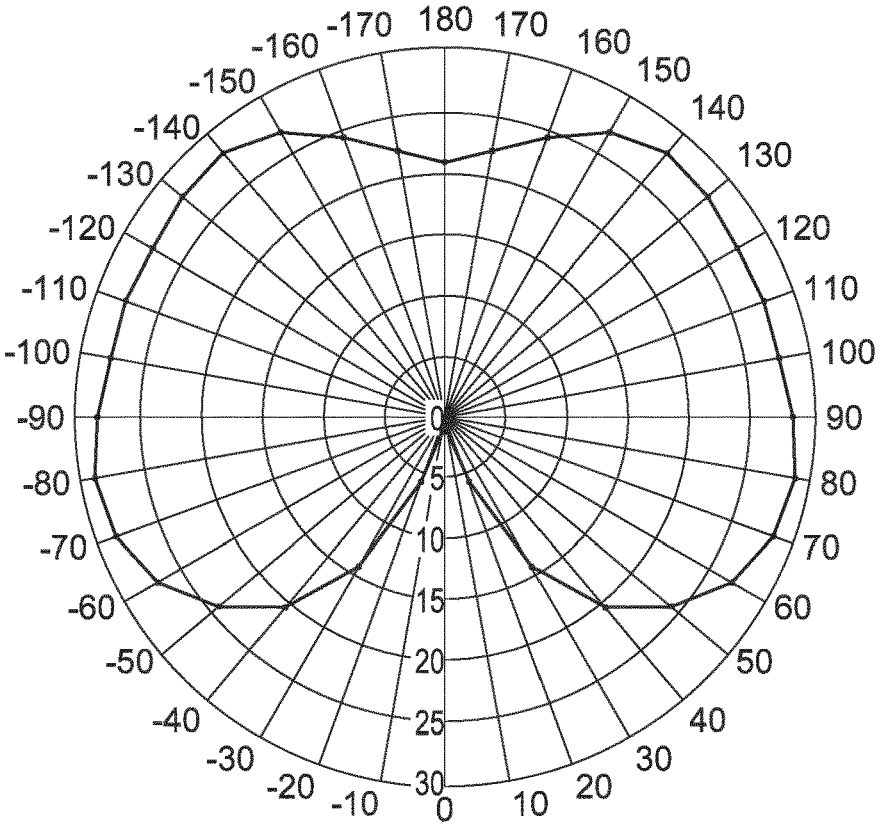

FIGS. 2*a*-2*b* schematically depicts an embodiment of such retrofit lamp with an optical element, and an associated intensity distribution. Here, the optical element has a pyramid shape.

FIGS. 1*a* and 2*a* schematically depict several aspects of embodiments of the invention. In FIG. 1*a*, a lighting device 10 is schematically depicted comprising a plurality of elongated filaments 100. FIG. 1*b* schematically depicts an embodiment of the elongated filaments and an optical element 200.

Each elongated filament 100 comprises a substrate or support (see FIGS. 11*a*-11*b*) and a plurality of solid state light sources configured to generate solid state light source light.

The elongated filament 100 has a first axis of elongation 120 having a first length L1. The elongated filament 100 is configured to generate filament light 101 over at least part of the first length L1.

The optical element 200 comprises a plurality of facets 210. Especially, adjacent facets 210 have mutual facet angles (unequal to 0°). The optical element 200 has a second axis of elongation 220 having a second length L2. Especially, the optical element 200 has a non-circular cross-section perpendicular to the second axis of elongation 220. Here, the optical element 200 comprises a single optical element unit 1200 (which both have a length L2).

The optical element 200 is configured between at least two of the plurality of elongated filaments 100. The optical element 200 is configured to redirect at least part of the filament light 101.

FIG. 2*a* also shows an embodiment wherein the optical element 200 comprises one or more optical element units 1200 (here one optical element unit 1200). The optical element unit 1200 comprises one or more of the plurality of facets 210. Especially, for one or more of the facets 210 of the optical element unit 1200 applies that a facet normal 211 configured perpendicular to the facet 211 complies with one of the conditions selected from (i) the facet normal 211 does not intersect with an adjacent elongated filament 100 (this may however be the case in the embodiment of FIG. 2*a*; see therefore also e.g. FIG. 7*b*, configurations X-XII), and (ii) the facet normal 211 and the axis of elongation 220 of an adjacent elongated filament 100 have a mutual angle β1 unequal to 90°, such as in the schematically depicted embodiments of e.g. FIGS. 2*a*, 3*a*, 4*a*, 5*a*, etc.

In this (and other) embodiment(s), the one or more facets 210 of the optical element unit 1200 are symmetrically configured relative to the second axis of elongation 220. Further, as schematically depicted in e.g. FIGS. 2*a*, 3*a*, 4*a*, 5*a*, etc. the one or more facets 210 of the optical element unit 1200 taper in a direction parallel to the axis of elongation 220.

FIG. 2*a* (but also e.g. FIG. 3*a*, FIG. 4*a*, FIG. 5*a*, etc.) also shows an embodiment, wherein the first axes of elongation 120 of the respective elongated filaments 100 are configured parallel to the second axis of elongation 220.

Further, FIG. 2*a* also shows an embodiment wherein the optical element unit 1200 comprises two or more of the plurality of facets 210, wherein two or more of the two or more facets 210 circumferentially surround the second axis of elongation 220, wherein adjacent facets 210 define a facet edge 212. Further, as schematically depicted one or more of the one or more optical element units 1200 each comprise 3-12 facets 210. In e.g. FIGS. 2*a* and 3*a*, the optical elements 200/optical element units 1200 comprise 4 facets (not taking into account the bottom facet).

Figure 3A:
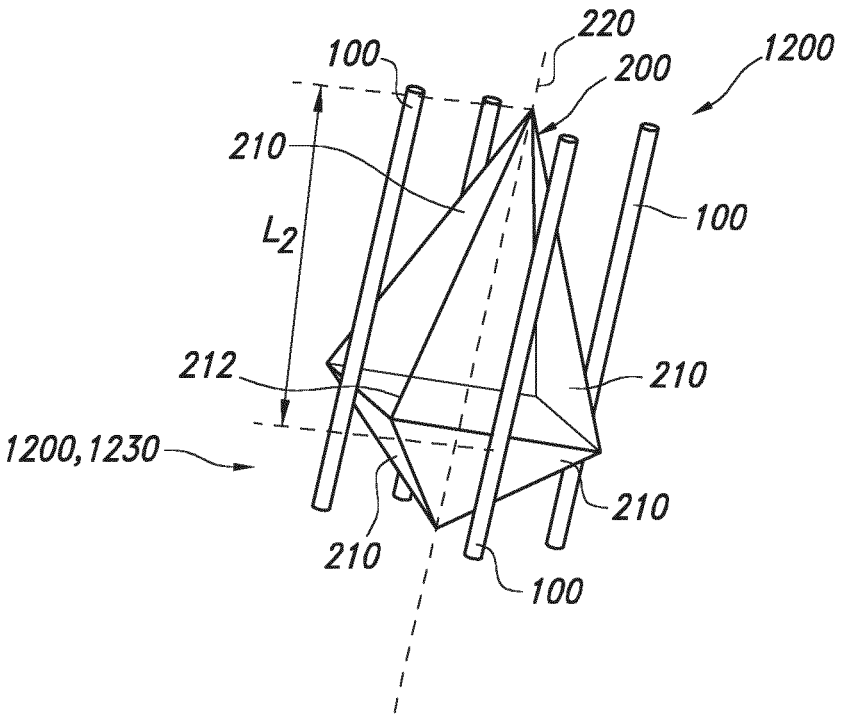
FIGS. 3*a*-3*b* schematically depicts an embodiment of such retrofit lamp with an another embodiment of the optical element, and an associated intensity distribution.
Figure 3B:
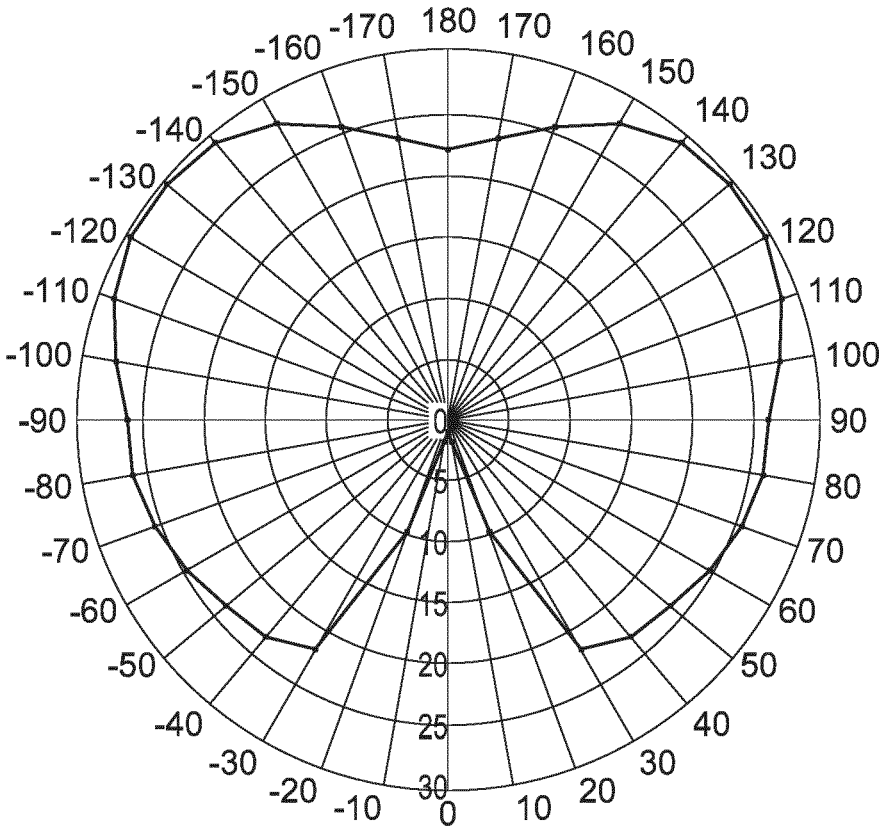

Especially, the reflective or refractive element may have a double pyramid shape i.e. two pyramid configuration. FIGS. 3*a*-3*b* schematically depicts an embodiment of such retrofit lamp with another embodiment of the optical element, and an associated intensity distribution (for the lamp, see FIG. 1*a*; here, only the relevant elements of the filaments and the optical element are schematically depicted).

FIGS. 3*a* (and 4*a*) shows an embodiment(s) one or more sets 1230 (here a single set), wherein the set 1230 comprises two adjacently configured optical element units 1200, wherein the optical element units 1200 within the set 1230 taper in opposite directions. The surface area of the top pyramid may be larger than the surface area of the bottom pyramid.

Figure 4A:
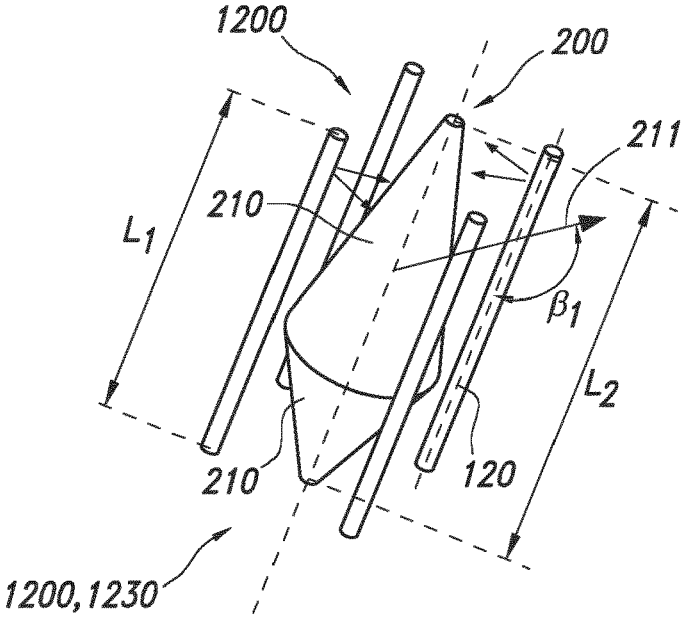
FIGS. 4*a*-4*b* schematically depicts an embodiment of such retrofit lamp with an another embodiment of the optical element, and an associated intensity distribution.
Figure 4B:
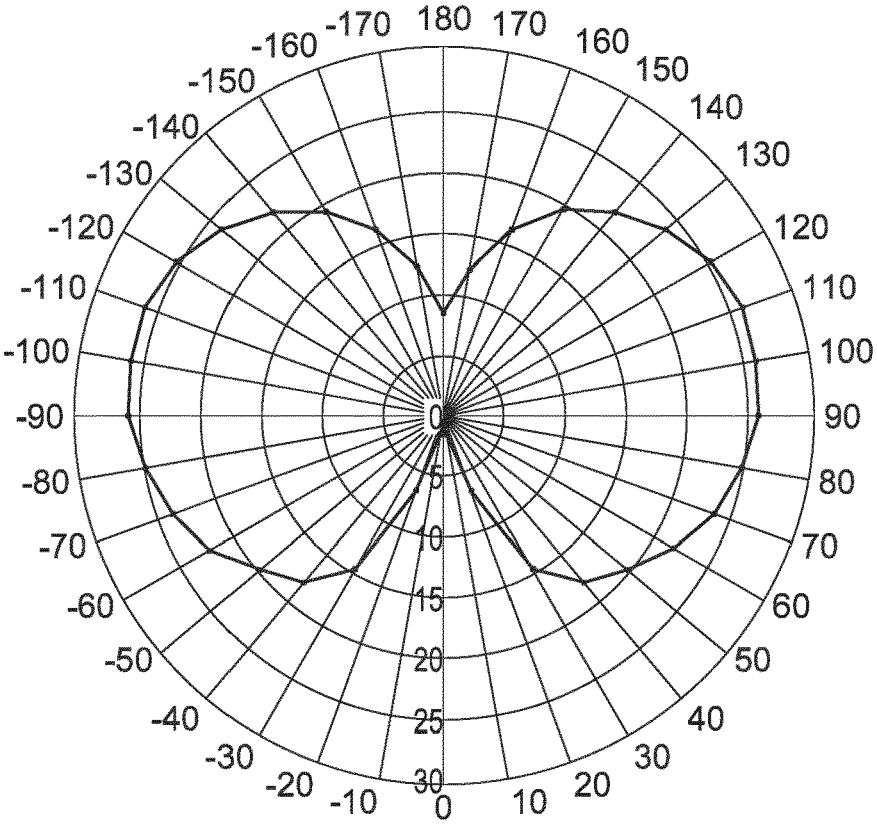

It appears that a faceted pyramid shaped reflector element outperforms a cone shaped design (i.e. round reflector as shown in FIGS. 4*a*-4*b*) because more light is redirected. FIGS. 4*a*-4*b* schematically depicts an embodiment of such retrofit lamp with another embodiment of the optical element, and an associated intensity distribution (again: for the lamp, see FIG. 1*a*; here, only the relevant elements of the filaments and the optical element are schematically depicted).

Figure 5A:
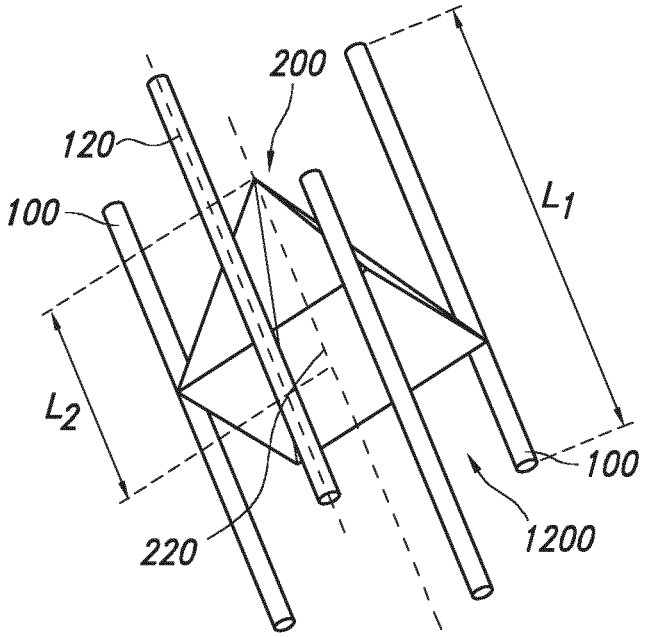
FIGS. 5*a*-5*b* schematically depicts an embodiment of such retrofit lamp with an another embodiment of the optical element, and an associated intensity distribution.
Figure 5B:
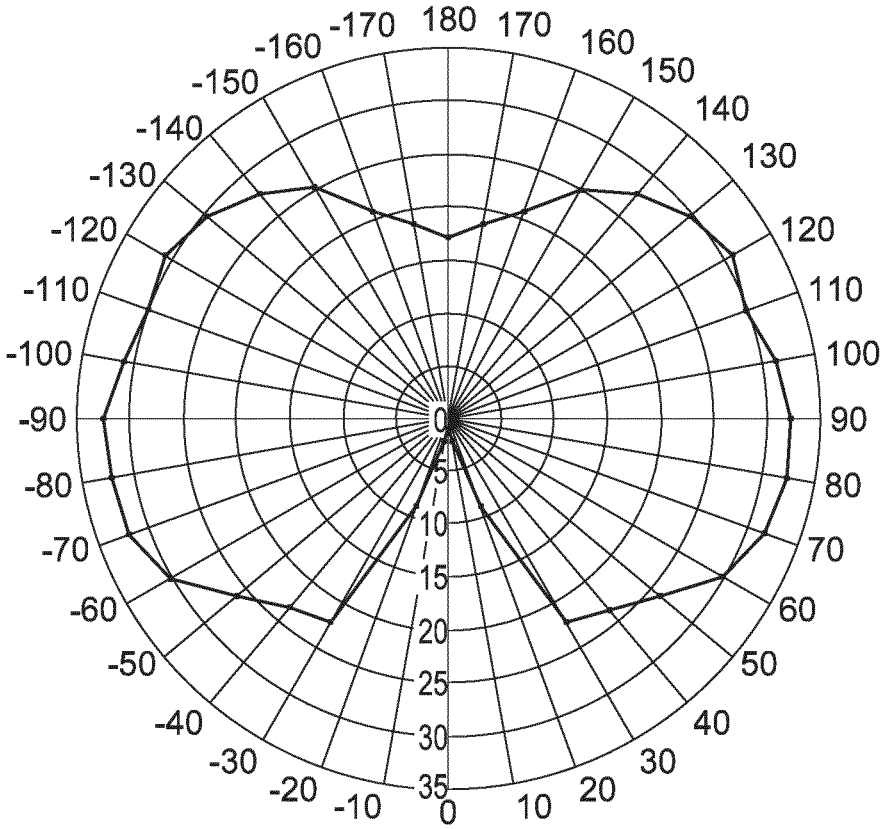

The design principle described above also hold for a refractive element. In other words, the refractive element is preferably faceted. For example, a refractive pyramid may be used. FIGS. 5*a*-5*b* schematically depicts an embodiment of such retrofit lamp with another embodiment of the optical element, and an associated intensity distribution (again: for the lamp, see FIG. 1*a*; here, only the relevant elements of the filaments and the optical element are schematically depicted).

Figure 6A:
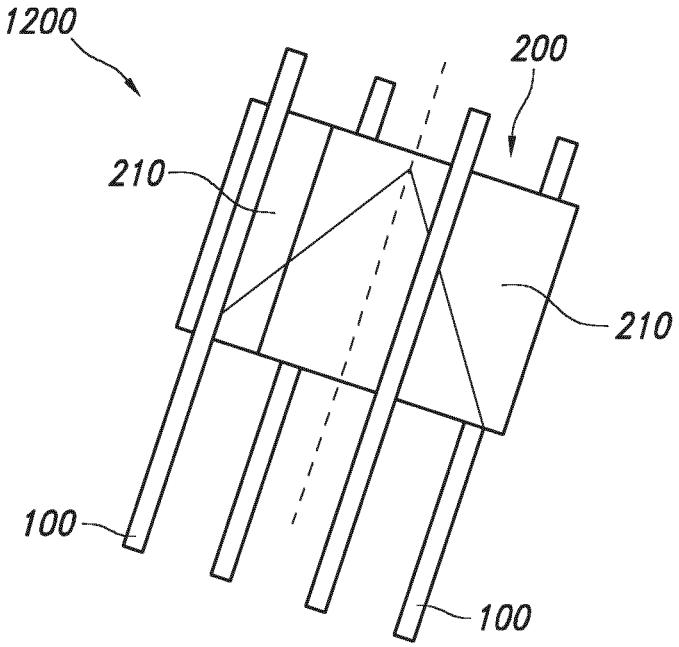
FIGS. 6*a*-6*b* schematically depicts an embodiment of such retrofit lamp with an another embodiment of the optical element, and an associated intensity distribution.
Figure 6B:
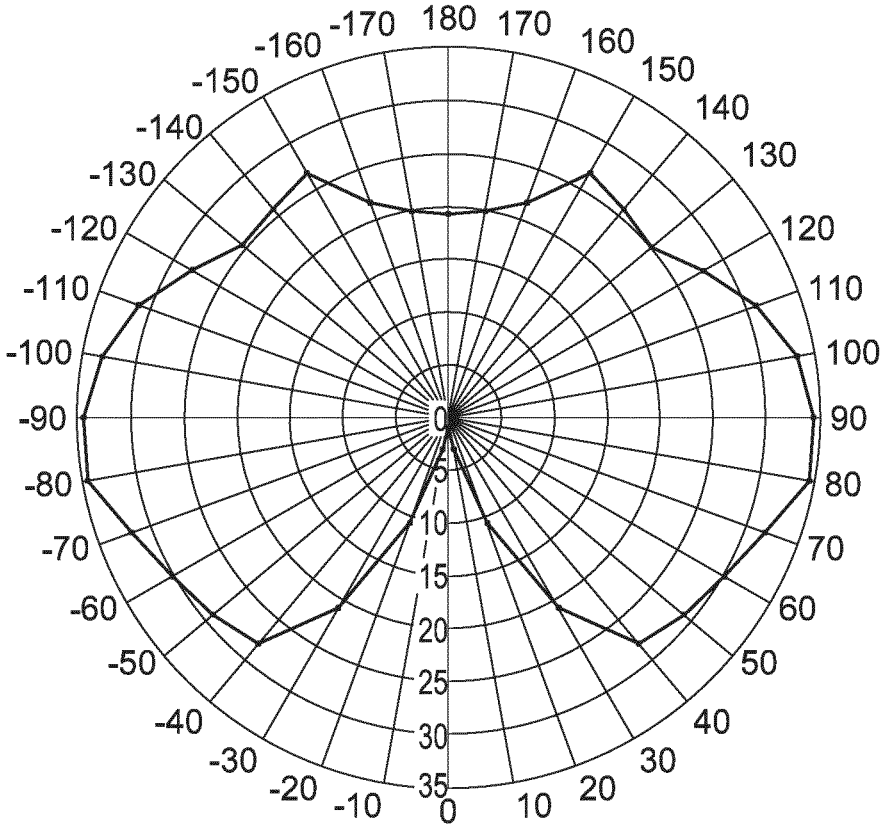

In another example a cube comprising a reflective/refractive pyramid cavity can be used. FIGS. 6*a*-6*b* schematically depicts an embodiment of such retrofit lamp with another embodiment of the optical element, and an associated intensity distribution (again: for the lamp, see FIG. 1*a*; here, only the relevant elements of the filaments and the optical element are schematically depicted).

FIGS. 7*a*-10*c* schematically depict some further embodiments.

Figure 7A:
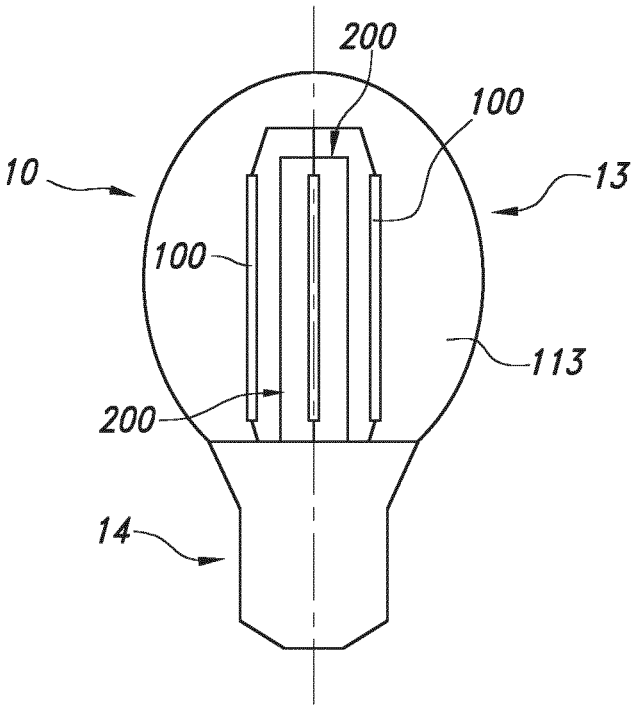
FIG. 7*a* schematically depicts an embodiment of a retrofit lam and an optical element.
Figure 7B:
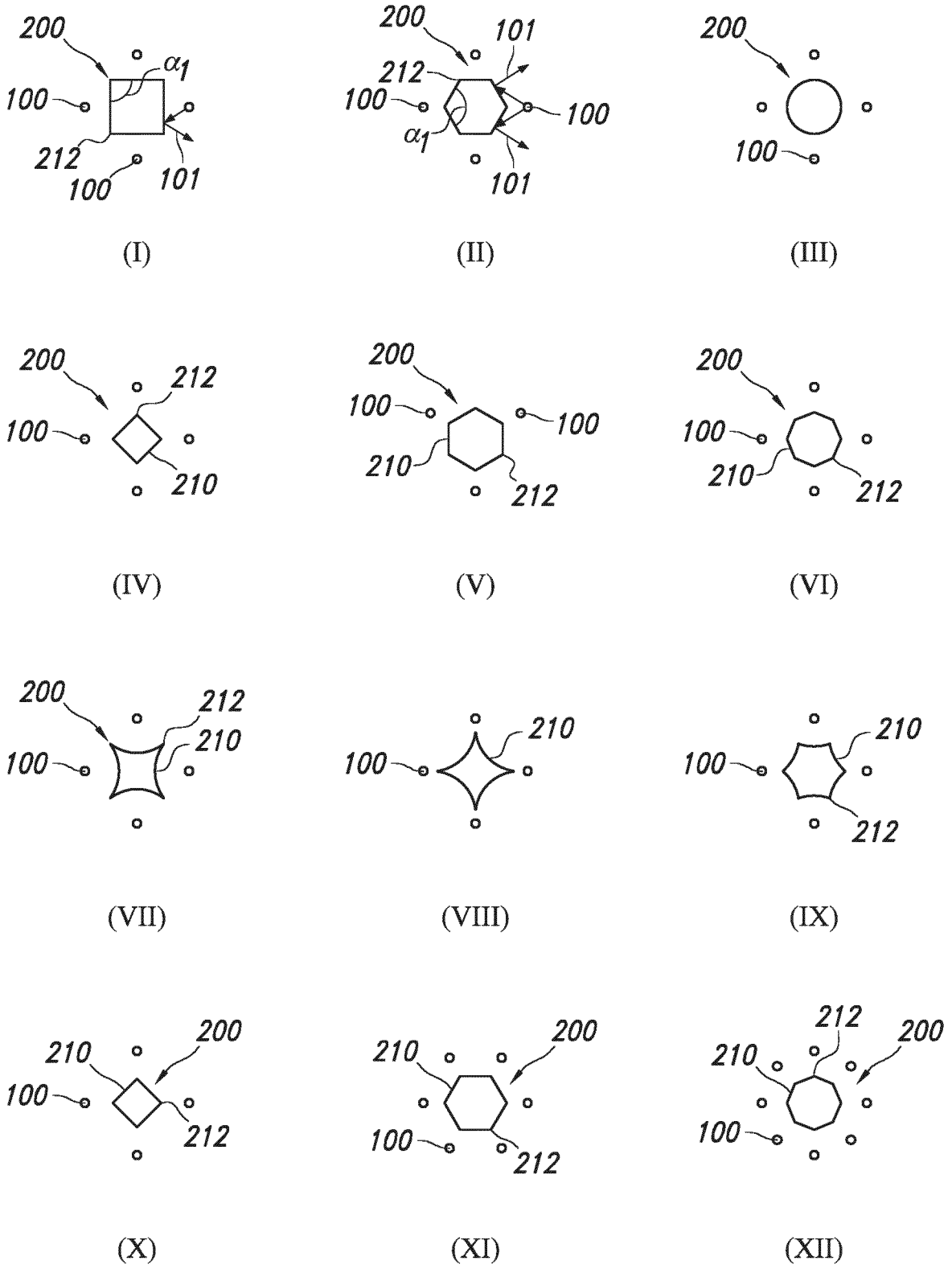
FIG. 7*b* schematically depicts a plurality of filament and optical element configuration.

FIG. 7*a* schematically depicts an embodiment of a retrofit lam and an optical element. FIG. 7*a* shows an embodiment of a basic LED filament bulb configuration with a centrally mounted optical element (such as a reflector). This embodiment includes configuration I with an elongated square reflector. FIG. 7*b* schematically depicts a plurality of filaments and optical element configuration (which may e.g. be applied in the embodiment of FIG. 7*a*). Configuration (II) shows an elongated hexagonal reflector, and configuration (II) shows a cylindrical reflector.

As an example, essentially all versions are shown here with four filaments.

To prevent reflection of light straight back onto the filament, as well as with the purpose to see multiple virtual sources, it may be advantageous to not let the normal of the reflector segment (essentially) coincide with the position of a filament. This results in preferred orientations of the centrally mounted segmented reflector, as shown for some basic configurations in FIG. 7*b* configurations IV-VI. Here, a centrally mounted reflector where the reflector segment normals are non-coinciding with the filament positions are schematically depicted. Configuration IV shows an elongated square reflector, configuration V shows an elongated hexagonal reflector, and configuration VI shows an elongated octagonal reflector.

In the embodiments of configurations IV-VI one or more of the facet edges 212, one or more of the first axes of elongation and the second axis of elongation, are configured in a plane.

In this set of configurations, all versions IV through VI) show a lay-out where all segment normals do not (essentially) coincide with the filament positions. In this example this was realized by using an integer multiplier of 1 (for configuration IV) or 2 (for V and VI) as the relation between the number of filaments and the number of segments, and although this results in nicely symmetrical configurations, this does not necessarily have to be the case.

The reflector segments would not necessarily need to be flat. It may even be advantageous to use concave or convex segments as this enables either a more homogeneous (local) distribution of brightness, or enables preventing occurrence of perceived increased brightness as it shows the virtual (reflected) sources at larger distances from the direct-view source. Some basic embodiments with concave reflector segments are shown in FIG. 7*b* configurations VII-IX. Here, embodiments with centrally mounted reflectors with concave reflector segments are schematically depicted. Configuration VII shows an elongated 4-segment concave reflector where the segment normal are coinciding with the filament positions, configuration VIII shows an elongated 4-segment concave reflector where the segment normals do not (essentially) coincide with the filament positions, and configuration IX shows an elongated hexagonal concave reflector (having by way of example a combination of coinciding and non-coinciding configurations of filament and reflector normals). As an example, essentially all versions are shown here with 4 filaments. Hence, here embodiments are schematically depicted wherein one or more of the facets 210 are concave. In an alternative embodiment of configuration VII of FIG. 7B, the reflector segments partially surround the filaments 100, i.e. at least a part of the filament 100 is positioned in a virtual space defined by the surface of the facet 210 and a plane bounded by two opposing facet edges 212 of that facet 210. Alternatively, the filament 100 is completely positioned in a virtual space defined by the facet 210 and a plane bounded by two opposing facet edges 212 of that facet 210. The optical element 200 may be transparent. An advantage of this configuration is that the uniformness of the illumination pattern in the far field is further improved. In case of a transparent optical element 200, the filaments are still visible from all viewing angles.

The examples shown above used in most cases just four filaments, but of course extension of the number of filaments to a lower or higher count are possible. A configuration with 3 filaments was already shown in configuration V. As an example, configurations X-XII show some basic embodiments for the extension from 4 to 6 and 8 filaments in combination with respective a square, a hexagonal, and an octagonal central reflector. Hence, configurations with a centrally mounted reflector with increasing number of filaments. Configuration X shows an elongated 4-segment reflector where the segment normals are not coinciding with the filament positions, configuration XI shows an elongated 6-segment reflector where the segment normals do not (essentially) coincide with the six filament positions, and configuration XII shows an elongated octagonal reflector, where the segment normals do not (essentially) coincide with the eight filament positions.

In most of the above examples, the number of filaments and the number of reflector segments were chosen equal, but of course also other ratios can be used, such as four filaments with an octagonal reflector.

Figure 8A:
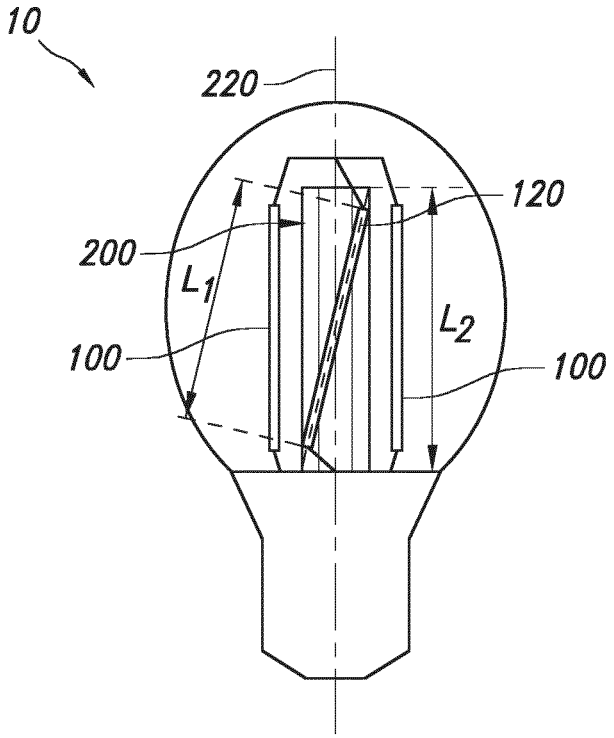
FIG. 8*a* schematically depicts another embodiment of a retrofit lam and an optical element.
Figure 8B:
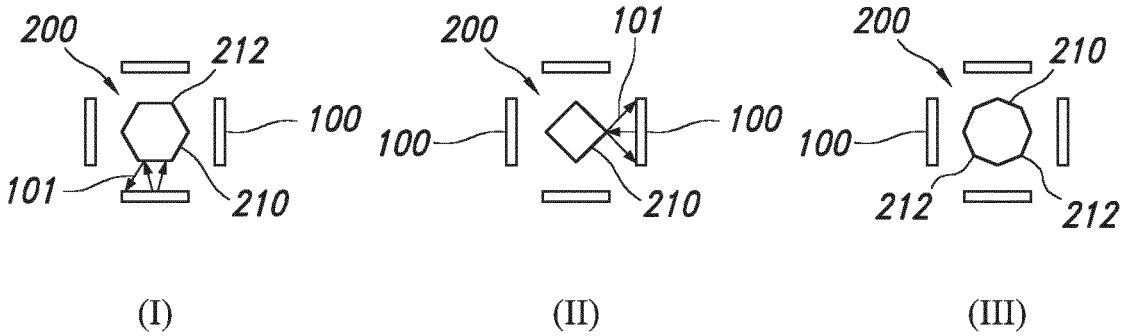
FIG. 8*b* schematically depicts a plurality of filament and optical element configuration.

So far, the filaments were depicted all in parallel with the elongation direction of the centrally mounted reflector. However, it may be beneficial to tilt the filaments such that as a function of height the orientation towards, or position relative to, the reflector varies, resulting in a more diverse brightness distribution of the (virtual) sources. This is shown for some basic configurations in FIGS. 8*a*-8*b*. Here, configurations are depicted with a centrally mounted reflector, where the filaments are tilted in the tangential planes around the reflector. Configurations I, II, and III show respective configurations with a hexagonal (6 segment), a square (4 segment), and an octagonal (8 segment) reflector. All versions are shown here with 4 filaments as an example. FIG. 8*a* schematically depicts another embodiment of a retrofit lam and an optical element. Here, one or more of the plurality of first axes of elongation 120 are slanted relative to the second axis of elongation 220. FIG. 8*b* schematically depicts a plurality of filament and optical element configuration (that may e.g. be used in the embodiment of FIG. 8*a*).

Figure 9A:
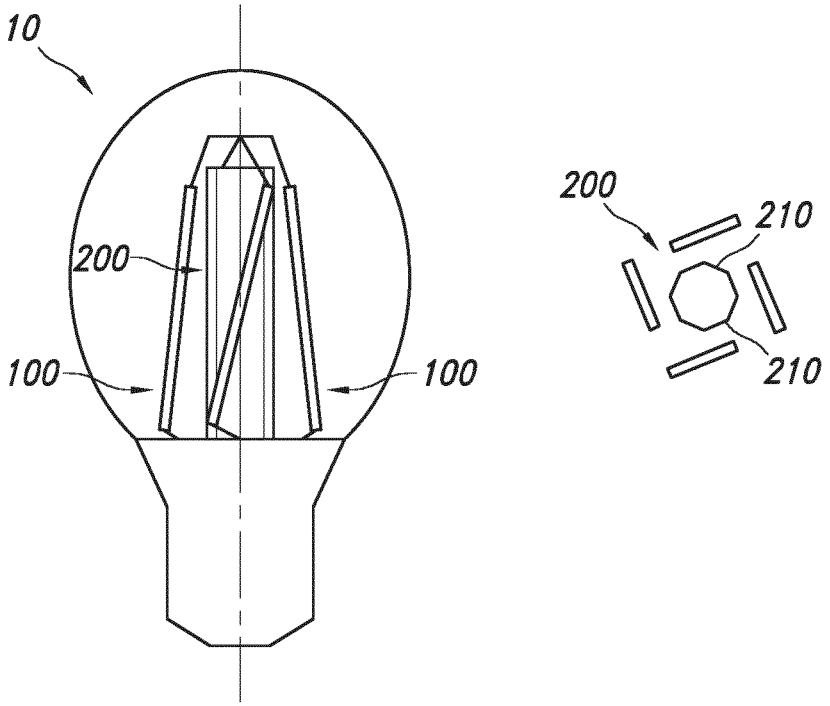
FIGS. 9*a*-9*b* schematically depict some further embodiments.
Figure 9B:
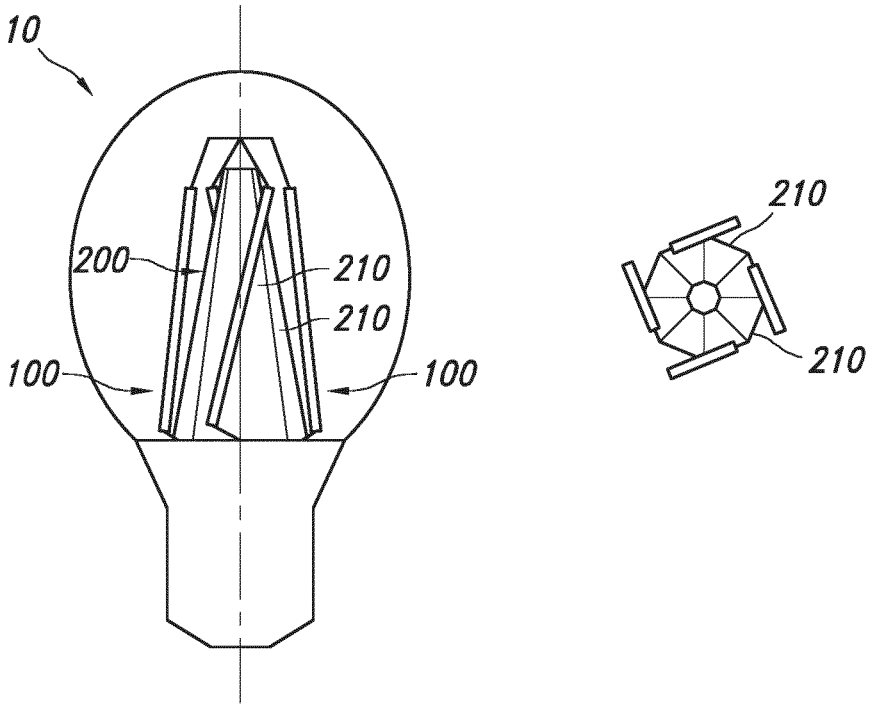

As a further extension of meaningful orientations of the filaments, they may be tilted radially inwards or outwards with respect to the optical axis of the lamp or central reflector. The same holds for the average orientation of the reflector surfaces; also these may be tilted inwards or outwards with respect to the optical axis of the system. In particular for beam profile adjustments this can be meaningful, as the relative flux emitted in the longitudinal direction compared to that emitted radially is impacted by this. Some basic configurations are presented in FIGS. 9*a*-9*b*, which schematically depict some further embodiments. LED filament bulb configurations are schematically depicted with a centrally mounted reflector, where the filaments and/or the reflector segments are tilted in the radial direction with respect to the optical axis of the system. The configuration in FIG. 9*a* shows an octagonal cylindrical reflector with filaments that are tilted in both the tangential planes and in the radial planes. The configuration in FIG. 9*b* shows and octagonal reflector with radially tilted segments, combined with filaments that are tilted in both the tangential planes and in the radial planes. All versions are shown here with 4 filaments as an example. Of course the upside-down version of the configuration in FIG. 9*b* is possible and relevant as well.

Figure 10A:
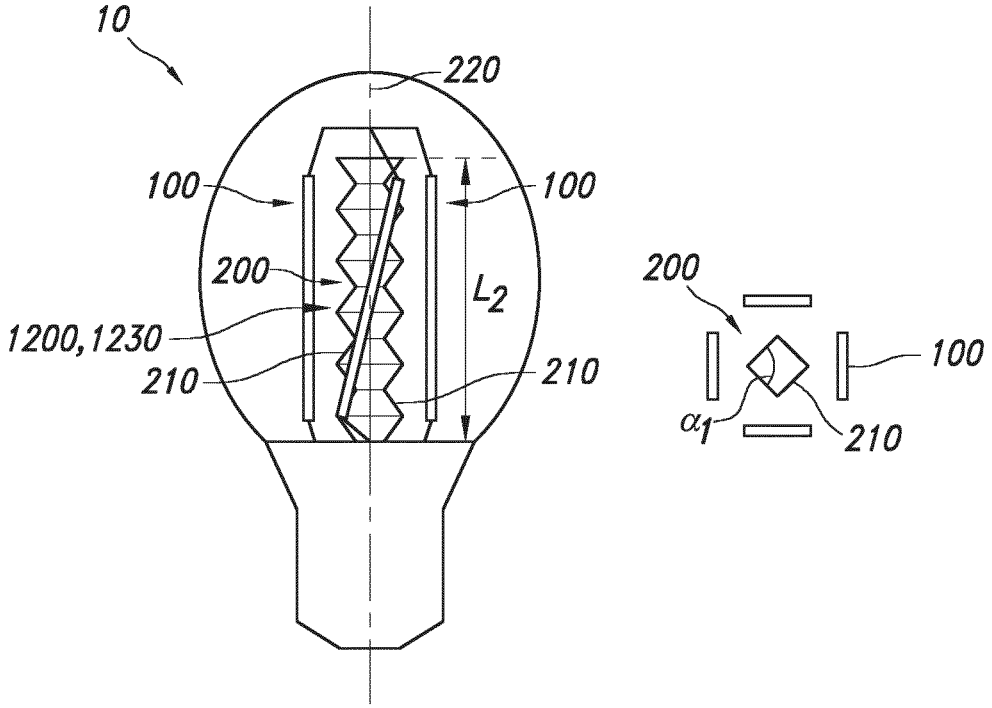
FIGS. 10*a*-10*c* schematically depict some further embodiments.
Figure 10B:
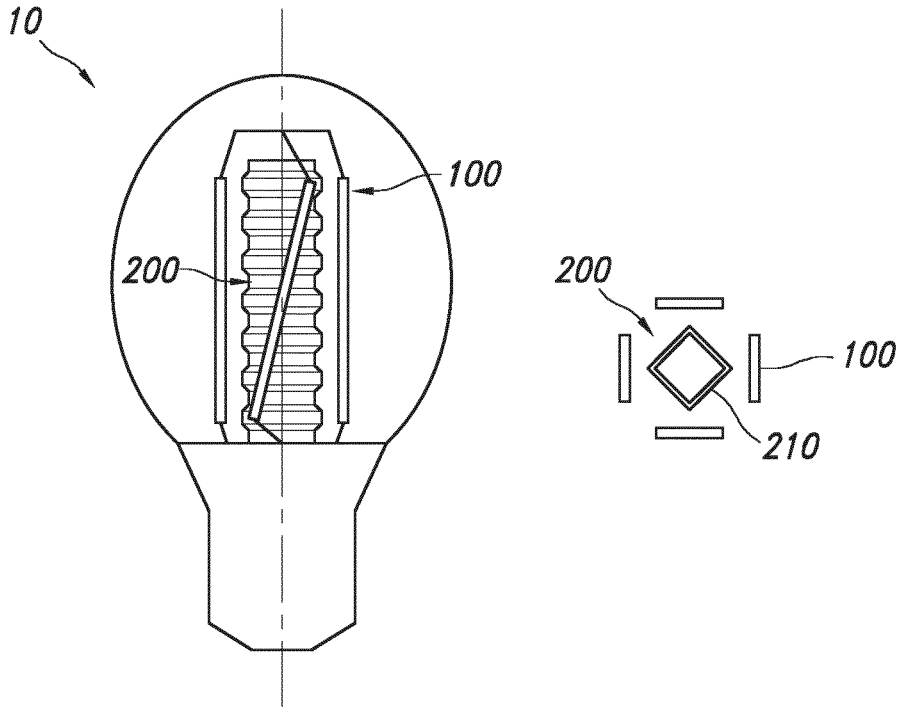
Figure 10C:
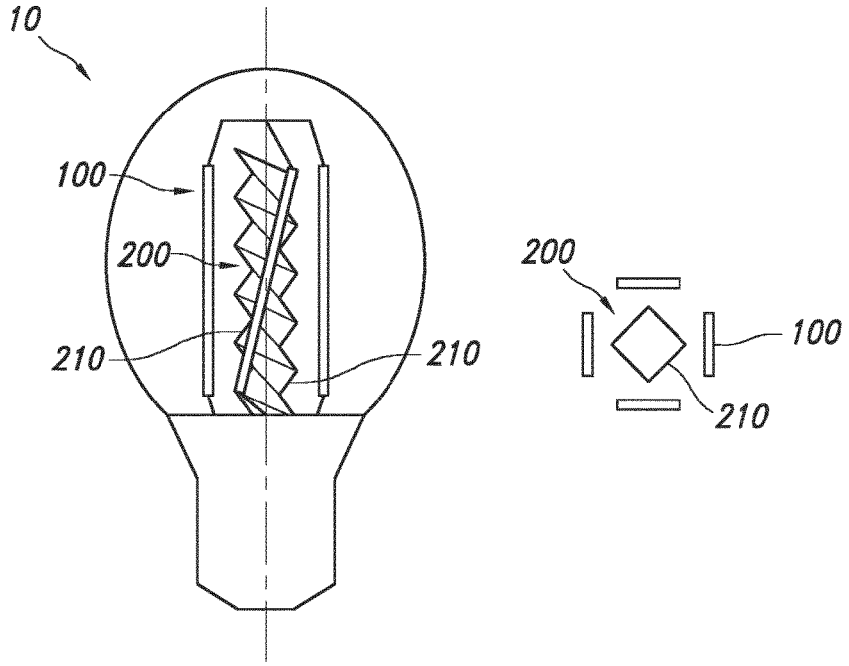

The reflector may, in alternative embodiments, be composed of segments that not only show variation in the direction of the surface normal as a function of the circumferential position, but also as a function of the height position. This enhances further sparkle effects and may be used as well for further beam shape optimization. Some examples are shown in FIGS. 10*a*-10*c*, which schematically depict some further embodiments. These figures schematically depicted also embodiments of LED filament bulb configurations with a centrally mounted reflector, where the reflector segments are tilted locally. The configurations of FIGS. 10 and 10*b* show a layered reflector configuration, while the configuration of FIG. 10*c* shows a spiraling reflector configuration. As an example, all versions are shown here with a square basic outline of the reflector and with 4 filaments.

Special effects may also be achieved by using a partially transparent/translucent and partly reflective central reflector structure. The reflection characteristics may be substantially specular. In other embodiments, however, the reflective layer may be spreading the beam substantially, as may be achieved by small curved surface elements such as a reflective granular surface structure.

It is obvious that many combinations of the aforementioned implementation options are possible with respect to the number of facets, number of filaments, orientation of the facets, orientation of the filaments, and optical nature of the reflector surface and the body of the reflector.

A general aspect of at least some of the embodiments shown is that one or more electrical leads is guided through the center of the reflector, but this is not necessarily the case; also electrical leads going back from the top of the filaments to the base of the lamp outside the central reflector are possible.

The examples shown here indicate that the various filaments are connected in parallel at their top, but of course they can be mounted as individually addressable or in series as well.

Filaments may be emitting substantially the same spectral content, but may also be configured to emit different spectral content. In particular for dynamic sparkling with multi-facetted centrally mounted reflectors in may be attractive to use different color points for some of the filaments.

Figure 11A:
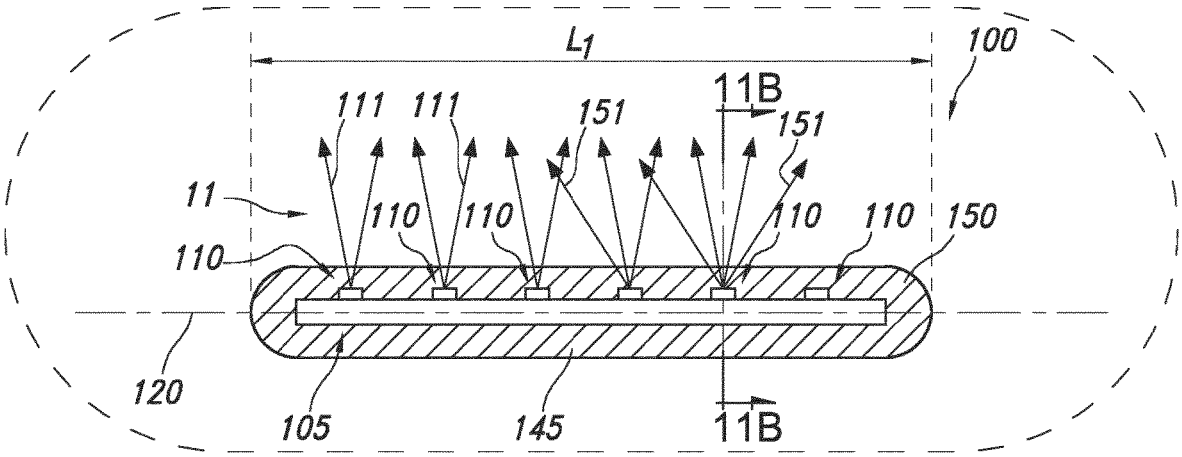
FIGS. 11*a*-11*b* schematically depict filament embodiments.
Figure 11B:
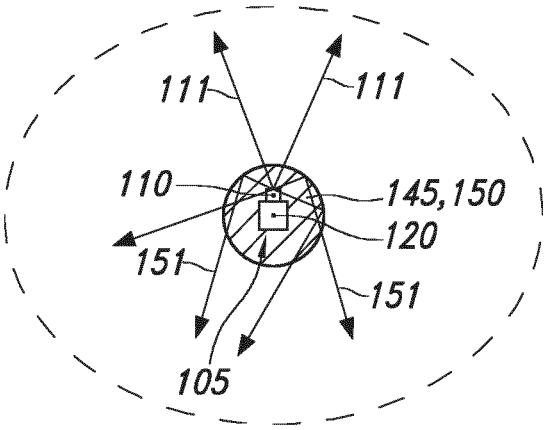

FIGS. 11*a*-11*b* schematically depict an embodiment of an elongated filament 100. The elongated filament 100 has a first length L1 along which light source light 11 is generated. Here, the elongated filament 100 comprises a plurality of solid state light sources 110, which are configured along the first length L1 and configured to generate solid state light source light 111.

In embodiments, the light source light 11 may essentially consist of the solid state light source light. In other embodiments, such as further described below, the light source light may comprise luminescent material light 151, which is based on an at least partial conversion of the solid state light source light 111 into luminescent material light 151 by a luminescent material 150. In yet further embodiments, the light source light may comprise luminescent material light 151 and solid state light source light 111.

The solid state light sources 110 may be available on a substrate 105. Further, the solid state light sources 110 (and the substrate 105) may especially be embedded in a light transmissive material (in general different from the light transmissive material of the light guide element), such as a resin. The light transmissive material enclosing the light sources is indicated with reference 145. Especially, the light transmissive material may comprise, such as embed, a luminescent material 150. Especially, this light transmissive material 145 may be a resin comprising luminescent material 150, such as an inorganic luminescent material in an organic resin. The resin may e.g. an acrylate or a silicone resin or an epoxy resin, etc.

Due to the fact that the light transmissive material 145 encloses the solid state light sources 110 and the substrate 105, light that is generated within the light transmissive material 145 may radiate in essentially any direction (perpendicular to an axis of elongation 110). This is also shown in the cross-sectional view in FIG. 11*b*. Hence, the elongated filament 100 in embodiments the elongated filament 100 is configured to provide light source light 11 in a plurality of directions perpendicular to the axis of elongation 120.

Hence, FIGS. 11*a*-11*b* schematically depict an embodiment of the elongated filament 100, wherein the elongated filament 100 comprises, wherein the elongated filament 100 comprises luminescent material 150 configured to convert at least part of the solid state light source light 111 into luminescent material light 151, and wherein the light source light 11 comprises the luminescent material light 151 and optionally solid state light source light 111. Reference 105 indicates a support or substrate.

As schematically depicted in FIGS. 11*a* and 11*b* with the dashed line, light source light 111 is generated over essentially 360° around the axis of elongation 110 (see FIG. 11*b*). With reference to FIG. 11*a*, relative to the axis of elongation 110 segments or a kind of elongated semi-circles, or a kind of elongated circles, can be defined, in which also light source light is generated over essentially 180° or 360°, respectively, see FIG. 11*a*.

The term "plurality" refers to two or more.

The terms "substantially" or "essentially" herein, and similar terms, will be understood by the person skilled in the art. The terms "substantially" or "essentially" may also include embodiments with "entirely", "completely", "all", etc. Hence, in embodiments the adjective substantially or essentially may also be removed. Where applicable, the term "substantially" or the term "essentially" may also relate to 90% or higher, such as 95% or higher, especially 99% or higher, even more especially 99.5% or higher, including 100%.

The term "comprise" includes also embodiments wherein the term "comprises" means "consists of".

The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices, apparatus, or systems may herein amongst others be described during operation. As will be clear to the person skilled in the art, the invention is not limited to methods of operation, or devices, apparatus, or systems in operation.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim.

Use of the verb "to comprise" and its conjugations does not exclude the presence of elements or steps other than those stated in a claim. Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

The article "a" or "an" preceding an element does not exclude the presence of a plurality of such elements.

The invention may be implemented by means of hardware comprising several distinct elements, and by means of a suitably programmed computer. In a device claim, or an apparatus claim, or a system claim, enumerating several means, several of these means may be embodied by one and the same item of hardware. The mere fact that certain measures are recited in mutually different dependent claims does not indicate that a combination of these measures cannot be used to advantage.

The invention also provides a control system that may control the device, apparatus, or system, or that may execute the herein described method or process. Yet further, the invention also provides a computer program product, when running on a computer which is functionally coupled to or comprised by the device, apparatus, or system, controls one or more controllable elements of such device, apparatus, or system.

The invention further applies to a device, apparatus, or system comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A lighting device comprising (i) a plurality of elongated filaments and (ii) an optical element, wherein:

each elongated filament comprises a support and a plurality of solid state light sources, wherein the elongated filament has a first axis of elongation having a first length, wherein the elongated filament is configured to generate filament light over at least part of the first length; and the optical element comprises a plurality of facets, wherein the optical element has a second axis of elongation having a second length, wherein the optical element has a non-circular cross-section perpendicular to the second axis of elongation, wherein the optical element is configured between at least two of the plurality of elongated filaments, and wherein the optical element is configured to redirect at least part of the filament light, wherein the optical element comprises one or more optical element units, wherein each optical element unit comprises one or more of the plurality of facets, wherein the one or more facets of the optical element unit are symmetrically configured relative to the second axis of elongation, and wherein the one or more facets of the optical element unit taper in a direction parallel to the axis of elongation and, the lighting device further comprising one or more sets, wherein each set comprises two adjacently configured optical element units, wherein the optical element units within the set taper in opposite directions.

2. The lighting device according to claim 1, wherein the optical element is configured to redirect at least part of the filament light by one or more of reflection at a facet and refraction at facets.

3. The lighting device according to claim 1, wherein the optical element is configured to redirect at least part of the filament light by diffuse reflection.

4. The lighting device according to claim 1, wherein the optical element comprises one or more optical element units, wherein each optical element unit comprises one or more of the plurality of facets, wherein for one or more of the facets of the optical element unit applies that a facet normal configured perpendicular to the facet complies with one of the conditions selected from (i) the facet normal does not intersect with an adjacent elongated filament, and (ii) the facet normal and the axis of elongation of an adjacent elongated filament have a mutual angle ($\beta 1$) unequal to 90°.

5. The lighting device according to claim 4, wherein the first axes of elongation of the respective elongated filaments are configured parallel to the second axis of elongation.

6. The lighting device according to claim 1, wherein the elongated filament comprises luminescent material configured to convert at least part of the solid state light source light into luminescent material light, and wherein the filament light comprises the luminescent material light and optionally the solid state light source light.

7. The lighting device according to claim 6, wherein the filament light is generated essentially 360° around the axis of elongation.

8. The lighting device according to claim 6, comprising a plurality of the sets.

9. The lighting device according to claim 1, wherein the optical element comprises one or more optical element units, wherein each optical element unit comprises two or more of the plurality of facets, wherein two or more of the two or more facets circumferentially surround the second axis of elongation, wherein adjacent facets define a facet edge.

10. The lighting device according to claim 9, wherein one or more of the one or more optical element units each comprise 3-12 facets.

11. The lighting device according to claim 9, wherein one or more of the facet edges, one or more of the first axes of elongation, and the second axis of elongation, are configured in a plane.

12. The lighting device according to claim 1, wherein one or more of the plurality of first axes of elongation are slanted relative to the second axis of elongation.

13. The lighting device according to claim 1, wherein one or more of the facets are concave.

14. The lighting device according to claim 1, wherein one or more of the plurality of elongated filaments is configured to provide more filament light in the direction of the optical element than in opposite directions.

15. The lighting device according to claim 1, comprising (i) a base, and (ii) an outer bulb, together defining an enclosure enclosing the plurality of elongated filaments and the optical element, wherein the solid state light sources comprise LEDs, and wherein the elongated filaments are straight elongated elements.

* * * * *